US005701568A

United States Patent [19]

Hiroshima et al.

[11] Patent Number: 5,701,568

[45] Date of Patent: Dec. 23, 1997

[54] IMAGE FORMING APPARATUS HAVING DIELECTRIC CONSTANT RELATIONSHIP BETWEEN IMAGE BEARING MEMBER, INTERMEDIATE TRANSFER MEMBER AND CONTACT TRANSFER DEVICE

[75] Inventors: Koichi Hiroshima, Shizuoka-ken; Katsuhiko Nishimura, Yokohama; Toru Kosaka, Machida; Yasuo Yoda, Numazu, all of Japan

[73] Assignee: Canon Kabushiki Kaisha, Tokyo, Japan

[21] Appl. No.: 705,822

[22] Filed: Aug. 30, 1996

[30] Foreign Application Priority Data

Sep. 1, 1995 [JP] Japan ..... 7-225239

[51] Int. Cl.[6] ..... G03G 15/01

[52] U.S. Cl. ..... 399/302; 399/308

[58] Field of Search ..... 399/302, 308, 399/313, 116

[56] References Cited

U.S. PATENT DOCUMENTS

| | | | |
|---|---|---|---|
| 5,084,735 | 1/1992 | Rimai et al. | 399/302 |
| 5,187,526 | 2/1993 | Zaretsky | 399/302 |
| 5,243,392 | 9/1993 | Berkes et al. | 399/308 |
| 5,409,557 | 4/1995 | Mammino et al. | 156/137 |
| 5,438,398 | 8/1995 | Tanigawa et al. . | |
| 5,510,886 | 4/1996 | Sugimoto et al. | 399/308 |
| 5,561,510 | 10/1996 | Kamp et al. | 399/308 |

*Primary Examiner*—Robert Beatty

*Attorney, Agent, or Firm*—Fitzpatrick, Cella, Harper & Scinto

[57] ABSTRACT

An image forming apparatus includes a first image-bearing member such as an electrophotographic photosensitive member, an intermediate transfer member for receiving a transferable image formed on the first image-bearing member, and contact transfer device for transferring the transferable image from the intermediate transfer member to a transfer material. The first image-bearing member has a surface layer having a dielectric constant $\epsilon_d$, the intermediate transfer member has a surface layer having a dielectric constant $\epsilon_{ITD}$ and the contact transfer device has a surface layer having a dielectric constant $\epsilon_{tr}$ satisfying a relationship of; $\epsilon_d \leqq \epsilon_{ITD} \leqq \epsilon_{tr}$. The intermediate transfer member exhibits a volume resistivity of $10^6$–$10^{10}$ ohm.cm (at an applied voltage of 1 kV), and the contact transfer device exhibits a volume resistivity of $10^8$–$10^{15}$ ohm.cm (at an applied voltage of 1 kV). As a result, it is possible to obtain high transfer efficiencies in both primary and secondary transfer over a wide transfer bias application range.

10 Claims, 13 Drawing Sheets

$$SF1 = \frac{(MXLNG)^2}{AREA} \times \frac{\pi}{4} \times 100$$

$$SF2 = \frac{(PERI)^2}{AREA} \times \frac{\pi}{4} \times 100$$

IMAGE FORMING APPARATUS HAVING DIELECTRIC CONSTANT RELATIONSHIP BETWEEN IMAGE BEARING MEMBER, INTERMEDIATE TRANSFER MEMBER AND CONTACT TRANSFER DEVICE

FIELD OF THE INVENTION AND RELATED ART

The present invention relates to an image forming apparatus, particularly an image forming apparatus, such as a copying machine, a printer and a facsimile apparatus, of a type wherein a transferable image (toner image) formed on a first image bearing member is once transferred to an intermediate transfer member as a second image bearing member (primary transfer), and then further transferred onto a transfer(-receiving) material as a third image-bearing member in pressure contact with the intermediate transfer member (secondary transfer) to obtain a product image (copy, print, etc.).

In the above, the first image bearing member may for example be a photosensitive member for electrophotography, a dielectric member for electrostatic recording, or a magnetic member for magnetic recording. Accordingly, the transferable image may be formed on the first image-bearing member by electrophotography, electrostatic recording, magnetic recording, etc. The intermediate transfer member (second image-bearing member) may for example be in the form of a roller (or drum) or a belt. The transfer(-receiving) material (third image-bearing member) may for example be transfer(-receiving) paper (plain paper), recording paper, print paper, a card, an envelope, a postcard, a transparent or opaque resin film, etc.

The above-mentioned type of image forming apparatus including an intermediate transfer member may be effectively used as a multi-color or full-color image forming apparatus for producing an image product synthetically reproducing color image data by sequentially transferring a plurality of component color developer (toner) images onto the intermediate transfer member and simultaneously transferring the images to a transfer material, or an image forming apparatus provided with a color image forming function in addition to a monochromatic image forming function, whereby it is possible to obtain a multi-color or full-color image free from deviation among the component color images (i.e., color deviation).

As a full-color image forming apparatus using an intermediate transfer member, there has been known one using a drum- or roller-shaped intermediate transfer member (as described in U.S. Pat. No. 5,187,526). FIG. 16 shows an outline of the image forming apparatus.

Referring to FIG. 16, an electrophotographic photosensitive drum (first image-bearing member) 1 rotating in a clockwise direction (indicated by an arrow) is uniformly charged by a corona charger 22 and exposed to image light 3 to form thereon an electrostatic latent image, which is developed with a developer comprising charged color particles (called "toner"). The toner image thus formed on the photosensitive drum 1 is transferred onto an intermediate transfer roller (second image-bearing member) 5 rotating synchronously at an identical speed with and in contact with or in proximity to the photosensitive drum 1 at a first transfer nip region N1 (primary transfer). The intermediate transfer roller 5 comprises a core metal 51 and a surface layer 52 thereon comprising a thin layer of electroconductive polyurethane and is supplied with bias voltage of a polarity opposite to that of the toner from a power supply 29 to receive the toner image on the photosensitive drum 1 by electrostatic transfer.

The toner image formation on the photosensitive drum 1 and the primary transfer of the toner image onto the intermediate transfer roller 5, may be repeated a number of times equal to the number of component colors required for providing objective full-color image data to effect superposition of transferred component color toner images on the surface of the intermediate transfer roller 5, thereby synthetically forming a full-color image corresponding to the objective color image data. The developing device 4 is exchanged and placed at a developing position for each developing device containing a prescribed color toner at each time of formation of a respective component color toner image on the photosensitive drum 1.

When the primary transfer of a final color toner image from the photosensitive drum 1 to the intermediate transfer roller 5 is performed, a transfer material P, such as transfer paper, is supplied from paper supply unit to a second transfer nip region N2 between the intermediate transfer roller 5 and a transfer roller (contact transfer member) 7 at a prescribed time, whereby the full-color image formed on the intermediate transfer roller 5 is transferred to the transfer material P (secondary transfer).

The transfer roller 7 comprises a core metal 71 and a surface layer 72 thereon comprising a thin layer of electroconductive polyurethane. At the time of primary transfer of toner images from the photosensitive drum 1 to the intermediate transfer roller 5, the core metal 71 is connected to the ground 71 via a switch 90 and, at the time of secondary transfer of a full-color image from the intermediate transfer roller 5 to the transfer material P, the core metal 71 is connected to a bias power supply 72 having a polarity opposite to that of the toner and a voltage larger than that of the supply 29 to the core metal 51 of the intermediate transfer roller 5.

The transfer material P having received the transferred full-color image from the intermediate transfer roller 5 is introduced to a fixing device (not shown) and subjected to an image fixing treatment to provide a full-color image product.

Supplementing some description, the apparatus further includes a cleaner 13 for the photosensitive drum 1, and a cleaner 80 for the intermediate transfer roller 5. The cleaner 80 is moved to contact and be separated from the intermediate transfer roller 5 by a shifting means (not shown) and is moved and held at a position separated from the intermediate transfer roller 5 at least during a period from the commencement of primary transfer of toner images from the photosensitive drum 1 to the intermediate transfer roller 5 until the completion of secondary transfer of a full-color image from the intermediate transfer roller 5 to the transfer material P. It is also possible to design that the transfer roller 7 is also moved to contact and be separated from the intermediate transfer roller 5 as desired and is held in contact with the intermediate transfer roller 5 during the secondary transfer of a full-color image from the intermediate transfer roller 5 to the transfer material P.

In the above-described apparatus, the use of a drum- or roller-shaped intermediate transfer member 5 provides an advantage that a full-color image free from color deviation can be obtained by a simple structure not requiring a moving speed correction mechanism compared with a belt-shaped intermediate transfer member. Further, such an image forming apparatus allowing primary transfer of an image formed on a first image-bearing member to an intermediate transfer member and secondary transfer to a transfer material, is advantageous not only for color image formation as described above but also for image formation on such a transfer material that the direct transfer of an image formed on an image-bearing member onto the transfer material is difficult, such as very thin paper or sheet or very thick paper. This is because it is not easy to support and convey such a transfer material to a position surrounding the first image-bearing member. Further, such an image forming apparatus including an intermediate transfer member is also advantageous in the case of using paper as a transfer material because paper dust is less liable to be attached to the first image-bearing member.

Such an image forming apparatus including two transfers is, however, required to exhibit a high image transfer efficiency and be free from image deterioration in either of the two times of transfer.

SUMMARY OF THE INVENTION

Accordingly, a principal object of the present invention is to provide an image forming apparatus including an intermediate transfer member, capable of exhibiting a high transfer efficiency and free from image quality lowering at the time of transfer.

According to the present invention, there is provided an image forming apparatus, comprising a first image-bearing member, an intermediate transfer member for receiving a transferable image formed on the first image-bearing member, and contact transfer means for transferring the transferable image from the intermediate transfer member to a transfer material; wherein the first image-bearing member has a surface layer having a dielectric constant $\epsilon_d$, the intermediate transfer member has a surface layer having a dielectric constant $\epsilon_{ITD}$ and the contact transfer means has a surface layer having a dielectric constant $\epsilon_{Tr}$ satisfying a relationship of; $\epsilon_d \leqq \epsilon_{ITD} \leqq \epsilon_{Tr}$, the intermediate transfer member exhibits a volume resistivity of $10^6$–$10^{10}$ ohm.cm (at an applied voltage of 1 kV), and the contact transfer means exhibits a volume resistivity of $10^8$–$10^{15}$ ohm.cm (at an applied voltage of 1 kV).

In case where the intermediate transfer member or the contact transfer means is composed of a single layer, the single layer per se is regarded as a surface layer in evaluating the conditions described herein.

According to the image forming apparatus of the present invention, it is possible to realize an image forming process free from transfer irregularity and exhibiting a high transfer efficiency. Further, it is possible to minimize the toner consumption and the amount of toner to be wasted. Particularly, a high secondary transfer efficiency is exhibited so that the cleaner for the image transfer material can be simplified. Further, superposed plural color toner images can be uniformly transferred including the uppermost toner layer and the lowermost toner layer, so that it is possible to provide an excellent color reproducibility that is regarded as most important in color image formation.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
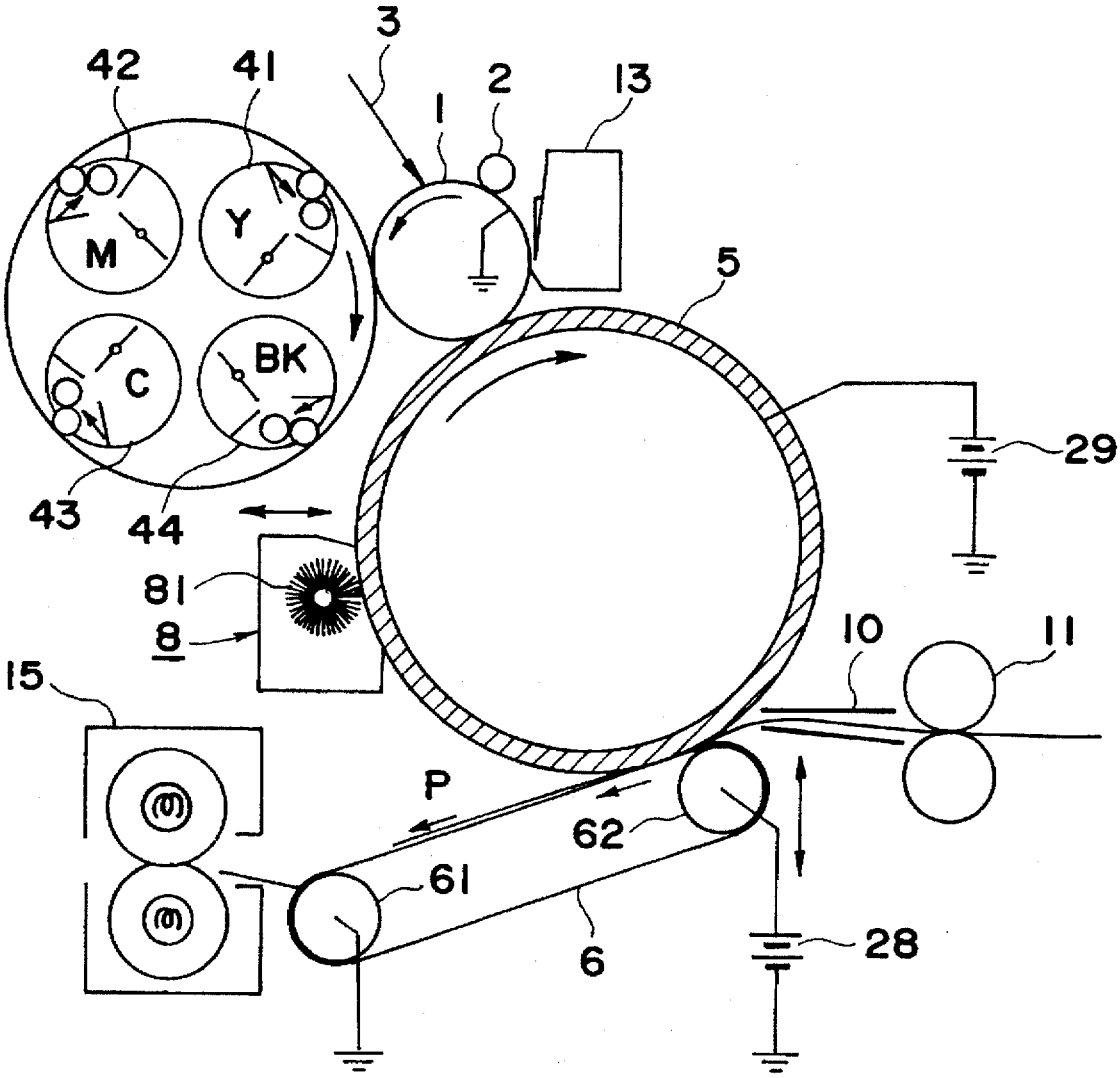
FIG. 1 is a schematic sectional view for illustrating an organization of an image forming apparatus according to a first embodiment of the invention.

The transfer efficiency and product image quality of an image forming apparatus including an intermediate transfer member have been found to remarkably depend on the resistivities and dielectric constants of the members involved in transfer of toner images. More specifically, if the intermediate transfer member has a volume resistivity (as measured under application of 1 kV, the same as hereinafter unless otherwise specified) of below $10^6$ ohm.cm, the transfer efficiency of toner from an intermediate transfer member to a transfer member (hereinafter called a "secondary transfer efficiency") is lowered. If the volume resistivity is above $10^{11}$ ohm.cm, the transfer efficiency of toner from a first image-bearing member such as a photosensitive drum to an intermediate transfer member (hereinafter called a "primary transfer efficiency") is lowered. This is presumably because, in case where two high-resistivity members rotate while contacting each other under application of a high voltage, a discharge phenomenon (peeling discharge) following the Paschen's law occurs at the time of separation therebetween to cause an increased Mount of inversely charged toner resulting in a re-transfer (or back transfer) phenomenon. In a transfer step under a low voltage application, the peeling discharge does not occur, thus causing no retransfer. Moreover, in case where the volume resistivity of an intermediate transfer member exceeds $10^{11}$ ohm.cm, the primary transfer bias (voltage) is raised and the secondary transfer bias (voltage) is superposed thereon, it becomes necessary to apply a higher bias than in the case of using an intermediate transfer member of a lower resistivity, thus adversely affecting the image quality and inviting a cost increase due to the necessity of a high voltage power supply.

Accordingly, it is preferred to suppress the resistivities of the intermediate transfer member and the secondary transfer means as low as possible within an extent allowed from the viewpoint of product image quality. In order to provide a primary transfer efficiency and a secondary transfer efficiency which are both high, the intermediate transfer member is required to exhibit a resistivity in the range of $10^6$–$10^{10}$ ohm.cm.

Also in the secondary transfer step of from the intermediate transfer member to a transfer member (third image-bearing member), the resistivity of the secondary transfer means remarkably affects the transfer efficiency and the product image quality. If the volume resistivity is below $10^8$ ohm.cm, it can be below that of paper in a low humidity environment, so that it becomes difficult to add a sufficient transfer charge onto the back surface of the paper, thus causing poor transfer. In case where the volume resistivity is above $10^{15}$ ohm.cm, the secondary bias is increased similarly as in the above-mentioned case of the intermediate transfer member, so that the retransfer due to peeling discharge is liable to occur and the power supply cost is increased.

Accordingly, in order to provide a high secondary transfer efficiency, the secondary transfer efficiency is required to have a volume resistivity in the range of $10^8$–$10^{15}$ ohm.cm.

In the present invention, in order to obtain high transfer efficiencies at low transfer voltages, the dielectric constants of the members involved in the transfer steps are specifically controlled so as to intensify the transfer electric field without applying a high transfer bias.

It is possible to increase the transfer efficiency by increasing the dielectric constant presumably because of the following reason. An electric field E1 between the first image-bearing member and the intermediate transfer member and an electric field E2 between the intermediate transfer member and the secondary transfer means may be determined according to the following equations (1) and (2), respectively:

$$E_1 = (V_d - V_{ITD1})/(d_d/\epsilon_d + d_{t1}/\epsilon_t + d_{ITD}/\epsilon_{ITD} + d_e/\epsilon_e + g_1) \quad (1)$$

$$E_2 = (V_{ITD2} - V_T)/(d_{ITD}/\epsilon_{ITD} + de/\epsilon_e + d_{t2}/\epsilon_t + d_p/\epsilon_p + d_{Tr}/\epsilon_{Tr} + g_2) \quad (2)$$

wherein the symbols represent the following values:

$V_d$: surface potential on the first image-bearing member;

$V_{ITD1}$: surface potential on the intermediate transfer member, $V_{ITD2}$: surface potential on the intermediate transfer member, $V_T$: surface potential on the secondary transfer means, $d_d$: thickness of recording layer of the first image-bearing member (i.e., a photosensitive layer (and an overcoating layer, if any) in case of a photosensitive member), $d_{t1}$: toner layer thickness on the first imagebearing member, $d_{ITD}$: surface layer (coating layer) thickness of the intermediate transfer member, $d_e$: elastic layer thickness of the intermediate transfer member, $d_{t2}$: toner layer thickness on the intermediate transfer member, $d_p$: thickness of transfer material, $d^{tr}$: thickness of the secondary transfer means, $\epsilon_d$: dielectric constant of surface layer of the first image-bearing member, $\epsilon_t$: dielectric constant of toner layer, $\epsilon_{ITD}$: dielectric constant of surface layer of the intermediate transfer member, $\epsilon_e$: dielectric constant of elastic layer of the intermediate transfer member, $\epsilon_p$: dielectric constant of transfer material, $\epsilon_{Tr}$: dielectric constant of surface layer of the secondary transfer means, g1: gap width between the first image-bearing member and the intermediate transfer member, and g2: gap width between the transfer material and the intermediate transfer member.

The transfer efficiency during electrostatic transfer of a toner is proportional to an electric field E applied across a gap between a transfer(-receiving) member or material and a toner layer. And, as is understood from the equations (1) and (2), larger dielectric constants provide increases in E1 and E2. On the other hand, between an electrostatic capacity C and a dielectric constant $\epsilon$, there is a relationship of $C=\epsilon\epsilon_0 S/d$ (wherein S: unit area, d: thickness, $\epsilon_0$: dielectric constant of vacuum (constant)). Accordingly, if the electrostatic capacities C of the first image-bearing member, the intermediate transfer member and the secondary transfer material are increased, the electric fields E are increased to provide increased transfer efficiencies.

On the other hand, for the purpose of increasing the transfer efficiency under a constant electric field E at the image-bearing member surface, it is believed effective to provide an increased charge density at the surface of a downstream-side transfer means in the case of both primary transfer and secondary transfer. According to the Gauss law, a surface charge density $\delta$ is given by $\delta=\epsilon\epsilon_0 E$, which also shows that a larger dielectric constant $\epsilon$ is advantageous.

This relationship holds true with the transfer between the first image-bearing member and the intermediate transfer member, and the transfer between the intermediate transfer member and the secondary contact transfer means.

Based on the above findings, in the present invention, the first image-bearing member, the intermediate transfer member and the secondary contact transfer means are desired to have dielectric constants $\epsilon_d$, $\epsilon_{ITD}$ and $\epsilon_{Tr}$, respectively, satisfying the relationship of $\epsilon_d \leqq \epsilon_{ITD} \leqq \epsilon_{Tr}$, preferably $\epsilon_d < \epsilon_{ITD} \leqq \epsilon_{Tr}$, more preferably $\epsilon_d + 1 < \epsilon_{ITD}$ and $\epsilon_{ITD} + 1 < \epsilon_{Tr}$.

The electrostatic capacities referred to herein are based on values measured in the following manner.

Figure 15:
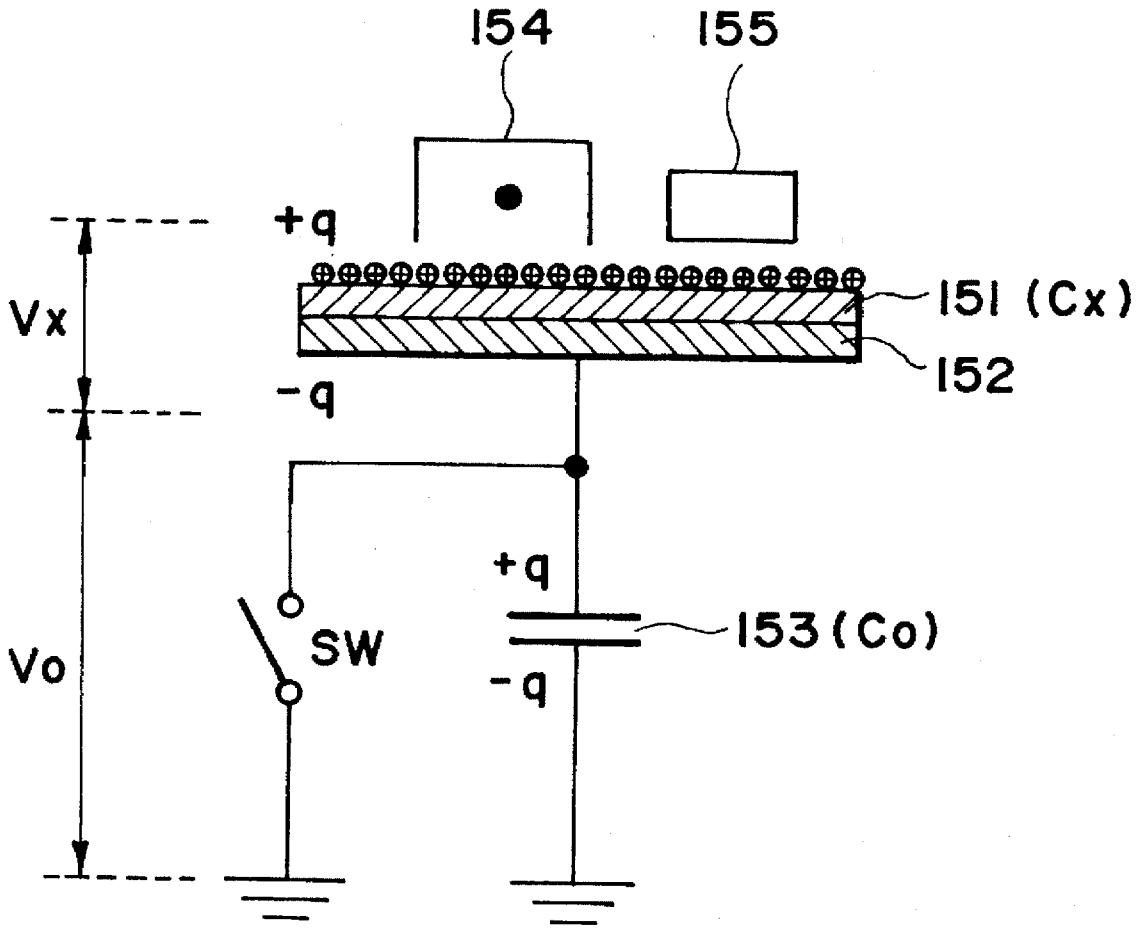
FIG. 15 is an explanatory view for illustrating a principle of electrostatic capacity measurement under a DC voltage.
Figure 16:
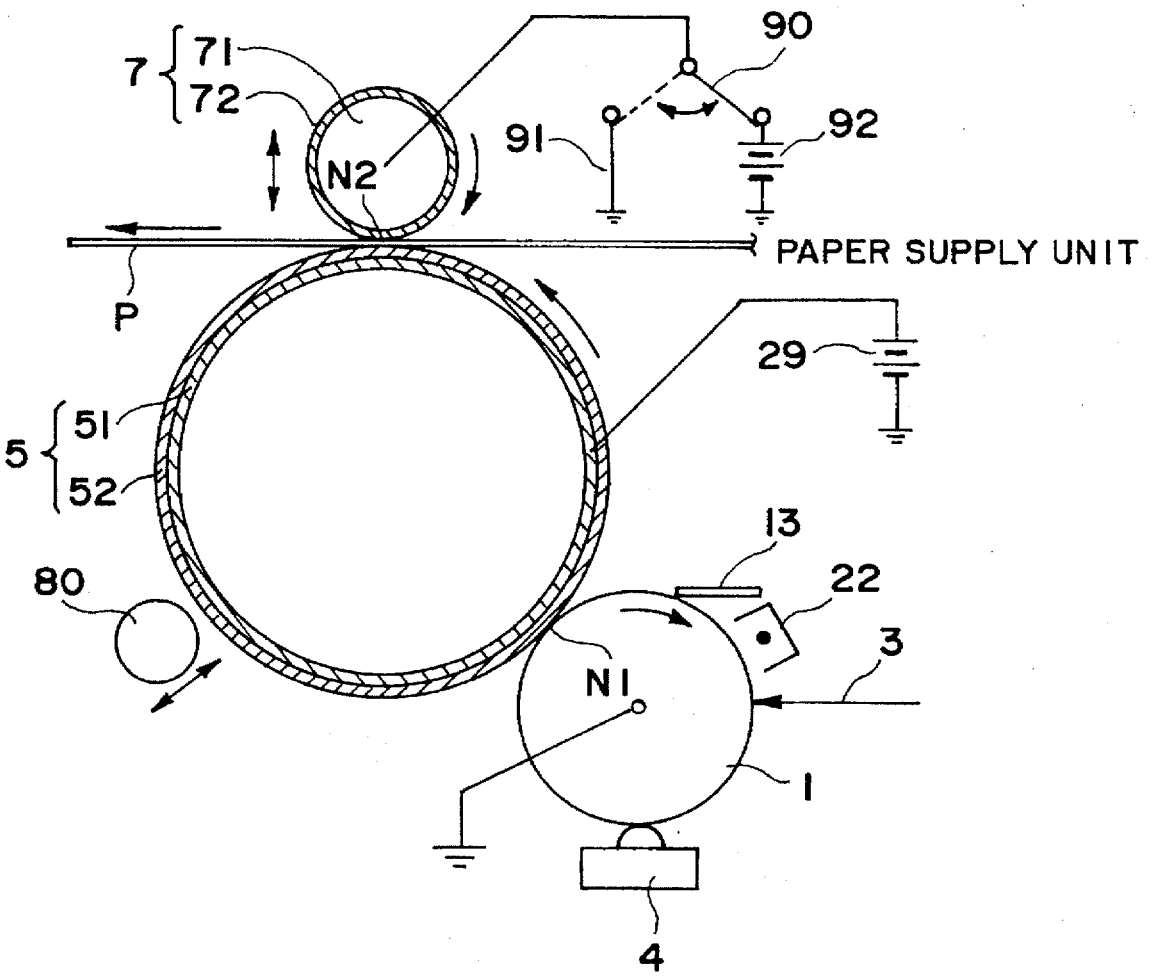
FIG. 16 is a schematic sectional illustration of an image forming apparatus including an intermediate transfer roller allowing superposed transfer.

FIG. 15 illustrates an outline of an electrostatic capacity measurement apparatus. The measurement is performed in the following manner.

1) A sample 151 having an electrostatic capacity $C_X$ to be measured is disposed on an electrode 152 which is grounded via a capacitor 153 having a known electrostatic capacity $C_0$, and is charged (provided with a charge q) by a corona charger 154.

2) A surface potential V1 of the sample 151 is measured by a surface potential meter 155 in the state where a switch SW is off.

3) Then, the switch SW is turned on to measure a surface potential V2 of the sample by the surface potential meter 155. The calculation is made based on the following equations:

$$V1=V_0+V_X=q/C_0+q/C_X \quad (3)$$

$$V2=V_X=q/C_X \quad (4)$$

By removing q from the above equations (3) and (4), the electrostatic capacity $C_X$ of the sample is given as follows:

$$C_X=[(V1-V2)/V2]\cdot C_0.$$

From the measured $C_X$, the dielectric constant $\epsilon_x$ is given a follows:

$$\epsilon_x=C_x\cdot d/(\epsilon_0\cdot S),$$

wherein d denotes a sample thickness and S denotes a sample surface area. The calculation of dielectric constants $\epsilon$ referred to herein are all based on the MKS-unit system.

As described above, by setting the intermediate transfer member to have a volume resistivity of $10^6$–$10^{10}$ ohm.cm, the secondary contact transfer means to have a volume resistivity of $10^8$–$10^{15}$ ohm.cm, and the first image-bearing member, the intermediate transfer member and the secondary contact transfer means to have surface layers having dielectric constants $\epsilon_d$, $\epsilon_{ITD}$ and $\epsilon_{Tr}$, satisfying the relationship of $\epsilon_d \leqq \epsilon_{ITD} \leqq \epsilon_{Tr}$, it becomes possible to obtain high transfer efficiencies at broad transfer bias voltage ranges for both the primary transfer and the secondary transfer. Further, even in case where the intermediate transfer member carries a portion of superposed toner layers and a portion of single toner layer in combination, both portions can be transferred without failure to provide a good transfer image. Further, it is possible to obtain images free from transfer irregularity or transfer dropout under both low-humidity and high-humidity environments.

Hereinbelow, some preferred embodiments of the present invention will be described.

First Embodiment

FIG. 1 is a schematic sectional view for illustrating an organization of an electrophotographic color image forming apparatus (copying machine or laser printer), including a medium-resistivity elastic roller 5 as an intermediate transfer member and a transfer belt 6 as a secondary contact transfer means.

More specifically, the image forming apparatus includes a rotating drum-type electrophotographic photosensitive member (hereinafter called a "photosensitive drum") 1 which is driven in rotation at a prescribed peripheral speed (process speed) in a counterclockwise direction indicated by an arrow.

During the rotation, the photosensitive drum 1 is uniformly charged to a prescribed polarity and potential by a primary charging roller 2 and exposed to image light 3 from an imagewise exposure means (not shown), such as a system for color resolution of a color original image and image formation exposure, or a scanning exposure system including a laser scanner for outputting a laser beam modulated corresponding to time-serial electric digital image signals carrying image data, to form thereon an electrostatic latent image corresponding to a first color-component image (e.g., a yellow-component image) of an objective color image.

Then, the electrostatic latent image is developed with an yellow toner Y as a first color toner by a first developing device (yellow developing device) 41. The respective developing devices, 41, 42, 43 and 44 containing yellow, magenta, cyan and black toners, respectively, are rotated in an indicated arrow direction by a rotation driving apparatus (not shown) so as to face the photosensitive drum 1 at the respective developing steps.

The intermediate transfer member 5 is driven in rotation in an arrow-indicated clockwise direction at a peripheral speed identical to that of the photosensitive drum 1.

Figure 2:
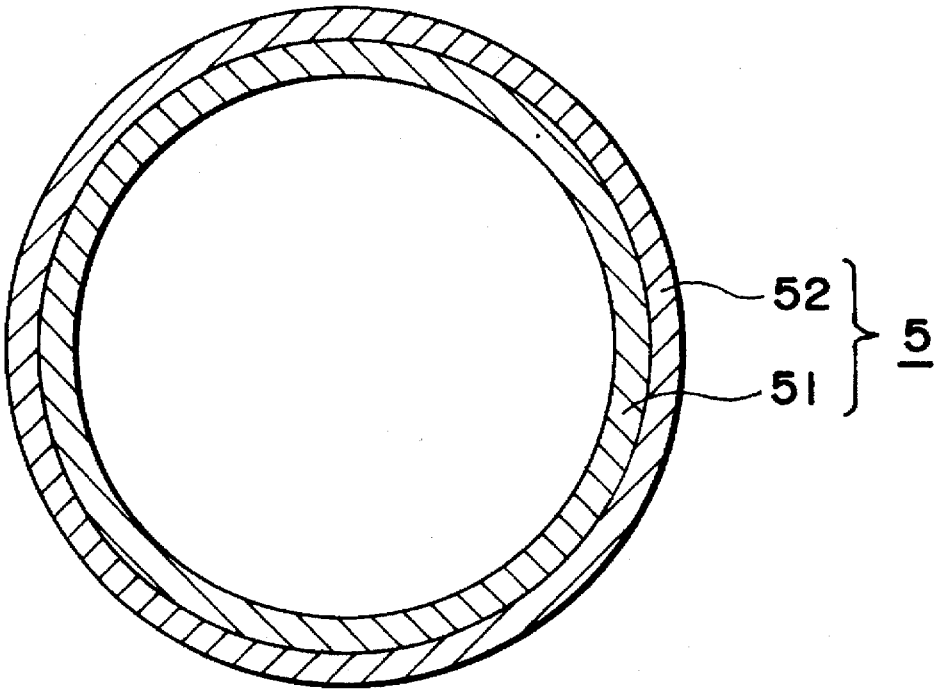
FIG. 2 is a sectional view of an intermediate transfer member incorporated in the laser printer.

The intermediate transfer member 5 used in this embodiment has a sectional structure as shown in FIG. 2, including a pipe-shaped core metal 51 and an elastic layer 52 formed on the outer periphery of the metal core 51.

The yellow (first color) toner image formed on the photosensitive drum 1 is transferred onto an outer peripheral surface of the intermediate transfer member 5 under the action of an electric field formed by a primary transfer bias supply 29 when it passes through a nip between the photosensitive drum 1 and the intermediate transfer member 5.

Then, the surface of the photosensitive drum 1 after transfer of the yellow (first color) toner image to the intermediate transfer member 5 is cleaned by a cleaning device 13.

Thereafter, a magenta (second color) toner image, a cyan (third color) toner image and a black (fourth color) toner image sequentially transferred in superposition onto the intermediate transfer member 5 to form a synthetic color toner image corresponding to the objective color image.

The image forming apparatus further includes a transfer belt 6, as a secondary contact transfer means, supported about shafts extending parallel to the intermediate transfer member 5 so as to contact a lower part of the intermediate transfer member 5. The transfer belt 6 is supported about a tension roller 61 and a bias roller 62. The bias roller 62 is supplied with a prescribed secondary transfer bias from a secondary transfer bias supply 28, and the tension roller 61 is grounded.

The primary transfer bias for sequential and superposed transfer of the first to fourth color toner images from the photosensitive drum 1 to the intermediate transfer member 5 is applied from the bias supply 29 in a polarity (+) opposite to that of the toner. During the sequential and superposed transfer of the first to fourth color toner images from the photosensitive drum 1 to the intermediate transfer member 5, the transfer belt 6 and the intermediate transfer member cleaner 8 may be separated from the intermediate transfer member 5.

The synthetic color toner image transferred in superposition onto the intermediate transfer member 5 may be transferred onto a transfer material P by causing the transfer belt 6 to abut on the intermediate transfer member 5 and supplying the transfer material P from a paper supply cassette (not shown) via register rollers 11 and a transfer preguide 10 to the nip between the intermediate transfer member 5 and the transfer belt 6 at a prescribed time, when a secondary transfer bias is simultaneously supplied from the bias supply 28 to the bias roller 62. As a result, the synthetic color toner image is transferred from the intermediate transfer member 5 to the transfer material P. The transfer material P carrying the transferred toner image is introduced into a fixing device and subjected to heat-fixing of the toner image thereonto.

After the completion of the toner image onto the transfer material P, the cleaner 8 is caused to abut the intermediate transfer member to remove the residual toner on the intermediate transfer member 5. The intermediate transfer member cleaner 8 comprises a fur brush 81 and is rotated in a reverse direction with respect to the intermediate transfer member 5 by a drive means (not shown) so as to scrape off the toner on the intermediate transfer member 5.

The laminar structure of the intermediate transfer member 5 will now be described with reference to FIG. 2 or FIG. 3, which is an enlarged partial sectional view of a surface portion of an intermediate transfer member 5.

Figure 3:
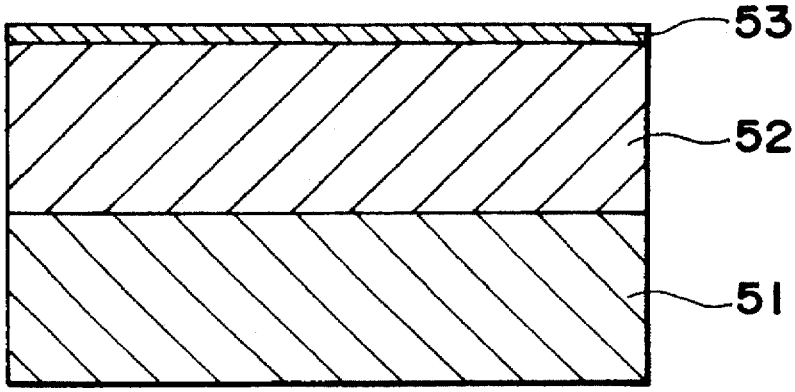
FIG. 3 is an enlarged partial sectional view showing a laminate structure of an intermediate transfer member.

Referring to FIGS. 2 and 3, the intermediate transfer members according to these embodiments comprise a cylindrical electroconductive support 51, an elastic layer 52 formed thereon comprising a rubber, an elastomer or a resin, and optionally at least one coating layer thereon, such as a release layer 53 (FIG. 3).

The cylindrical electroconductive support 51 may comprise a metal or alloy, such as aluminum, iron, copper or stainless steel, or an electroconductive resin containing electroconductive carbon or metal particles, etc., dispersed therein. The support may have a shape of a cylinder as described above, a cylinder equipped with a shaft passing therethrough or an internally reinforced cylinder. In a specific example, a core metal 51 comprised an internally reinforced 3 mm-thick aluminum cylinder.

The elastic layer 52 may desirably have a thickness of 0.5–5 mm in view of transfer nip formation, color deviation during rotation, material cost, etc. The release layer 53 may preferably be formed in a thickness of ca. 50–200 μm, so as to transmit the resilience of the elastic layer to the photosensitive member surface.

The intermediate transfer member used in the present invention is required to have a volume resistivity of $10^6$–$10^{10}$ ohm.cm. For this purpose, in a specific example, an elastic layer 52 was formed of acrylonitrile-butadiene rubber (NBR) containing ketjen black dispersed therein so as to adjust a volume resistivity.

Examples of other elastomers for constituting the elastic layer may include: styrene-butadiene rubber, butadiene rubber, ethylene-propylene rubber, chloroprene rubber, chlorosulfonated polyethylene, acrylonitrile-butadiene rubber, acrylic rubber, fluorine-containing rubber, and urethane rubber. Electroconductive particles dispersed therein may for example comprise carbon black, aluminum powder or nickel powder. Instead of using a resin containing electroconductive particles dispersed therein, it is also possible to use an electroconductive resin, examples of which may include: tertiary ammonium salt-containing polymethyl methacrylate, polyvinylaniline, polyvinylpyrrole, polydiacetylene and polyethyleneimine.

The volume resistivity values referred to herein are based on values measured with respect to a layer or a laminate structure except for a metal support, if any (e.g., a laminate of the elastic layer 52 and the release layer 53 in the case of a structure of FIG. 3) in the following manner. Such a layer or a laminate is cut out into a sheet of 100 mm×100 mm and subjected to measurement by using an insulating resistance meter "R8340A", available from Advantest Co.) and guard electrodes ("R12704", ditto). More specifically, such a sample sheet is sandwiched between a pair of electrodes after discharging for 5 sec. and then supplied with a voltage of 1 kV. At time of 30 sec. after start of the voltage application, a current detection system is connected to the voltage application system to measure a current across the sheet, from which is volume resistivity is measured.

The photosensitive drum 1 has a photosensitive layer which in turn comprises a carrier generation layer and a carrier transport layer.

The primary transfer efficiency 1 is related with the dielectric constant of a binder material used in a carrier transfer layer (hereinafter called a "CT layer") constituting a surface layer. In a specific example, the photosensitive drum 1 used was an OPC (organic photoconductor)-type having an outer diameter of 60 mm comprising an aluminum drum substrate coated successively with a 0.2 to 0.3 μm-thick carrier generation layer (CG layer) of phthalocyanine compound-dispersed polyvinylbutyral resin and a 15 to 25 μm-thick CT layer comprising a polycarbonate (PC) with a hydrazone compound dispersed therein. The CT layer showed a dielectric constant of ca. 3 when measured as a layer (151) directly applied on a 100 mm-square sheet (152) in the manner described with reference to FIG. 15.

The dielectric constant of the intermediate transfer member was controlled by the release layer 53.

More specifically, the release layer 53 comprised 33 wt. parts of a urethane resin binder, and 11 wt parts of potassium titanate (conductive material for resistivity control) and 56 wt. parts of polytetrafluoroethylene (PTFE) (releasability improver) dispersed therein. The release layer containing polyurethane having a higher dielectric constant than PC showed a dielectric constant of ca. 5 as measured by the above-mentioned method. More specifically, the above-mentioned release layer material was sprayed onto a 100 mm×10 mm-aluminum sheet to form a 100 μm-thick layer, which was charged by a corona charger 154 supplied with a constant current of DC 150 μA while being connected with a reference capacitance $C_0$ of $1\times10^{-12}$ F. The same conditions were adopted in the above-mentioned measurement for the CT layer.

Examples of other resins having high dielectric constants may include: polyvinylidene fluoride, polyamide, polyvinyl chloride, polyvinylidene chloride, polyamideimide, and polyurethane.

Examples of fillers having a high dielectric constant may include: powders of inorganic materials, such as calcium titanate, strontium titanate, barium titanate and titanium oxide, and an organic compound, such as polyvinylidene fluoride. Among these, calcined and pulverized powder of calcium titanate, strontium titanate or barium titanate exhibits a high dielectric constant of several thousands to tens and several thousands so that it is possible to provide a high dielectric constant by adding a small amount thereof to the intermediate transfer member.

As a test, several intermediate transfer members having different volume resistivities by including different resistivity of elastic layers 52 were prepared and evaluated with respect to the primary transfer efficiency. Each intermediate transfer member had an outer diameter of 180 mm.

The photosensitive drum 1 used in combination with the intermediate transfer members was a 180 mm dia.-OPC photosensitive drum as described above having a surface CT layer using a PC binder and showing a dielectric constant of ca. 3 and was subjected to image formation under the following conditions. On the photosensitive drum:

Dark part-potential (non-image part potential by primary charging): Vd=−700 V

Light part potential (image part potential by laser scanning): $V_l$=−150 V

Developing method: Jumping development using a non-magnetic mono-component developer Developing bias: Vdc=−450 V, Vac=1600 Vpp frequency=1800 Hz Process speed: 120 mm/sec.

The toner used was a non-magnetic monocomponent toner of the pulverization type comprising a styrene-acrylic resin binder, carbon black (colorant), metal salicylate (charge control agent) and low-molecular weight polyolefin (release agent) in mixture with ca. 2 wt. % of titanium oxide powder as a flowability improver.

The measurement was performed in an ordinary office environment of 23° C. and 50% RH. A primary transfer efficiency $\eta_{TF1}$ was calculated as follows based on the measured values of a transferred toner image density a on the intermediate transfer material and a residual toner image density h on the photosensitive drum:

$$\eta_{TF1}=[a/(a+b)]\times 100\%.$$

Figure 4A:
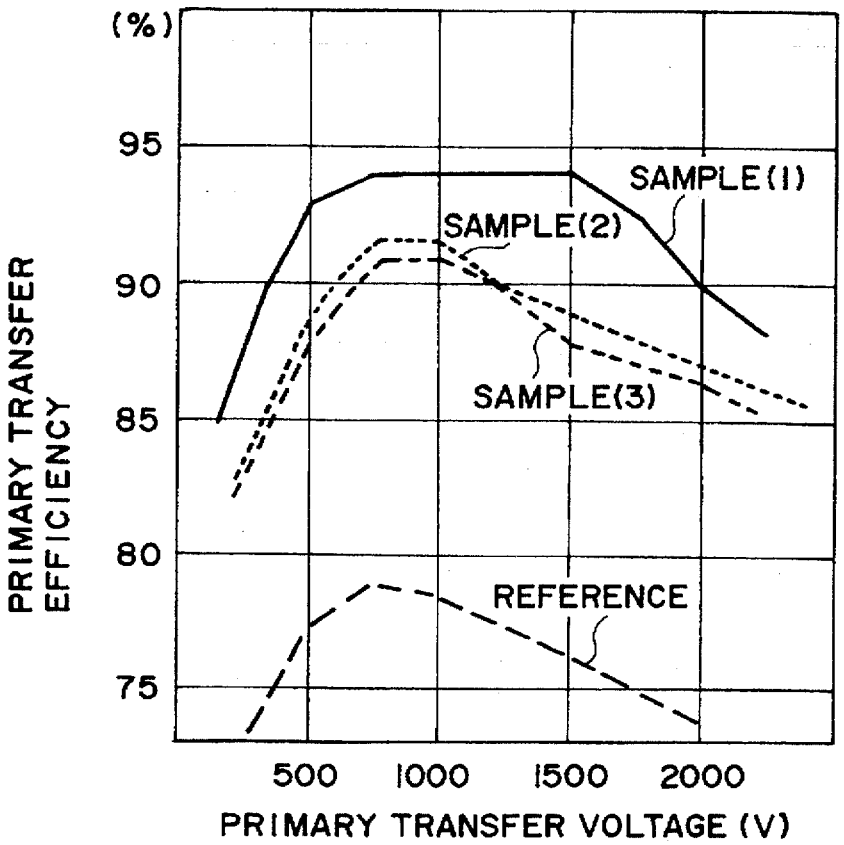
FIGS. 4A and 4B are graphs showing primary transfer efficiencies and secondary transfer efficiencies, respectively, in first type of image forming apparatus.

The measured results are summarized in the following Table 1 and FIG. 4A.

TABLE 1

Primary transfer efficiencies $2_{TF1}$ for intermediate transfer members having different dielectric constants and volume resistivities

| | Reference | Sample (1) | Sample (2) | Sample (3) |
|---|---|---|---|---|
| Elastic layer thickness (mm) | 2.0 | 0.5 | 2.0 | 5.0 |
| Surface layer thickness (μm) | 0 (none) | 200 | 100 | 50 |
| Surface layer dielectric constant $\epsilon_{ITD}$ | ca. 2 | ca. 5 | ca. 5 | ca. 5 |
| Volume resistivity (ohm.cm) | $1\times 10^9$ | $1\times 10^{10}$ | $5\times 10^8$ | $4\times 10^6$ |
| Maximum of primary transfer efficiency (%) | 78 | 94 | 92 | 91 |
| Transfer voltage range giving $2_{TF1} \geqq 90\%$ | none | 300–2000 | 600–1200 | 700–1200 |
| Quality of images on intermediate transfer member | **1 | **2 | **2 | **2 |

**1: Accompanied with roughening and transfer irregularity.
**2: Very good.

As is understood from Table 1, it has become possible to obtain a high primary transfer efficiency over a wide transfer voltage range by setting the intermediate transfer member to have a surface layer having a dielectric constant higher than that of the photosensitive drum while keeping the volume resistivity of the intermediate transfer member within a range of $1\times 10^6$–$1\times 10^{10}$ ohm.cm.

Next, the secondary transfer from the intermediate transfer member to the transfer material will be described.

In this embodiment, a transfer belt 6 is used. The bias roller 62 and the tension roller 61 supporting the transfer roller may be composed of an identical material or different materials. In specific examples, both rollers comprised a 8 mm-dia. SUS core metal coated with an NBR layer having a JI8 A rubber hardness of 30–35 deg. so as to provide an outer diameter of 20 mm. The rollers may preferably be controlled to have a volume resistivity of $1\times 10^6$–$1\times 10^{10}$ ohm.cm and may have a voltage-dependent resistivity which is desirably not so remarkable as to cause a remarkable decrease in resistivity at a high voltage. Other examples of the roller materials may include: ethylene-propylene-diene terpolymer (EPDM), urethane rubber, chloroprene rubber (CR) and other elastomers capable of dispersing an electroconductive filler therein.

In specific examples, the transfer belt 6 was formed in an original shape of tubes having 80 mm diameter and 300 mm width uniformly and having different thicknesses.

According to the present invention, the transfer belt is controlled to have a volume resistivity of $10^8$–$10^{15}$ ohm.cm and a relatively large dielectric constant $\epsilon_{Tr}$.

Preferred examples of materials for the transfer belt 6 may include: resins, such as polycarbonate (PC), nylon (PA), polyester (PE), polyethylene naphthalate (PEN), polysulfone (PSU), polyether sulfone (PES), polyether imide (PEI), polyether nitrile (PEN), polyether ether ketone, thermoplastic polyimide (TPI), thermoserring polyimide (PI), PES alloy, polyvinylidene fluoride (PVdF), and ethylene-tetrafluoroethylene copolymer; and elastomers, such as polyolefin-type thermoplastic elastomers, polyester-type thermoplastic elastomers, polyurethane-type thermoplastic elastomers, polystyrene-type thermoplastic elastomers, fluorine-containing thermoplastic elastomers, polybutadiene-type thermoplastic elastomers, polyethylene-type thermoplastic elastomers, ethylene-vinyl acetate-type thermoplastic elastomers, and polyvinyl chloride-type thermoplastic elastomers.

Some of the above-mentioned materials may have a relatively high dielectric constant per se but most have a dielectric constant on the order of 3–5. Accordingly, in order to provide a surface layer having a relatively high dielectric constant, a high-dielectric constant filler may be incorporated in the materials for the surface layer. Examples of such a high-dielectric constant filler have been describbed with reference to the fillers for the intermediate transfer member and are therefore not repeated here.

As specific examples, 6 transfer belts including three having a higher dielectric constant and three having a lower dielectric constant than the dielectric constant (ca. 3) of the above-described intermediate transfer member, when measured in manners similar to those described above for the intermediate transfer member.

Belt (1): Formed of a composition comprising PC as a base material, ketjen black (conductive filler) and titanium oxide (dielectric constant controller) to have a volume resistivity of $5\times 10^{13}$ ohm.cm and a dielectric constant of ca. 7, and in a thickness of 150 μm.

Belt (2) (for comparison with Belt (1)): Formed of a composition comprising PC as a base material and ketjen black to have a volume resistivity of $5\times 10^{13}$ ohm.cm and a dielectric constant of ca. 3 (lower than ca. 5 of the intermediate transfer member) and in a thickness of 150 μm.

Belt (3): Formed of a composition comprising ETFE as a base material, ketjen black (conductive filler) and titanium oxide (dielectric constant controller) to have a volume resistivity of $1\times 10^{15}$ ohm.cm and a dielectric constant of ca. 9, and in a thickness of 75 μm.

Belt (4) (for comparison with Belt (3)): Formed of a composition comprising ETFE as a base material and ketjen black to have a volume resistivity of $1\times 10^{15}$ ohm.cm and a dielectric constant of ca. 4 and in a thickness of 75 μm.

Belt (5): A two-layer structure including a 500 μm-thick substrate layer of polyester polyurethane and carbon black (conductive filler) and a 50 μm-thick surface layer comprising a flufine-containing resin mixture of PVdF and PTFE and having a dielectric constant of ca. 9 so as to provide an overall volume resistivity of $5\times 10^8$ ohm.cm.

Belt (6) (for comparison with Belt (5)): A two-layer structure including a 500 μm-thick substrate layer of polyester polyurethane and carbon black (conductive filler) and a 50 μm-thick surface layer comprising only PTFE and having a dielectric constant of ca. 5 so as to provide an overall volume resistivity of $5\times 10^8$ ohm.cm.

The above-prepared various transfer belts were tested for measurement of secondary transfer efficiencies in combination with the above-prepared intermediate transfer member of Sample (1) for transfer onto coated paper of 80 g/m$^2$ (prescribed for use in Canon laser copier "CLC") as a transfer material.

The primary transfer conditions were the same as above for the evaluation of the intermediate transfer members.

The secondary transfer was performed under a constant current condition. A secondary transfer efficiency $\eta_{TF2}$ was calculated s follows based on the measured values of a residual toner image density b' and a transferred toner image density c on the transfer material.

$$\eta_{TF2}=[c/(b'+c)]\times 100(\%).$$

Figure 4B:
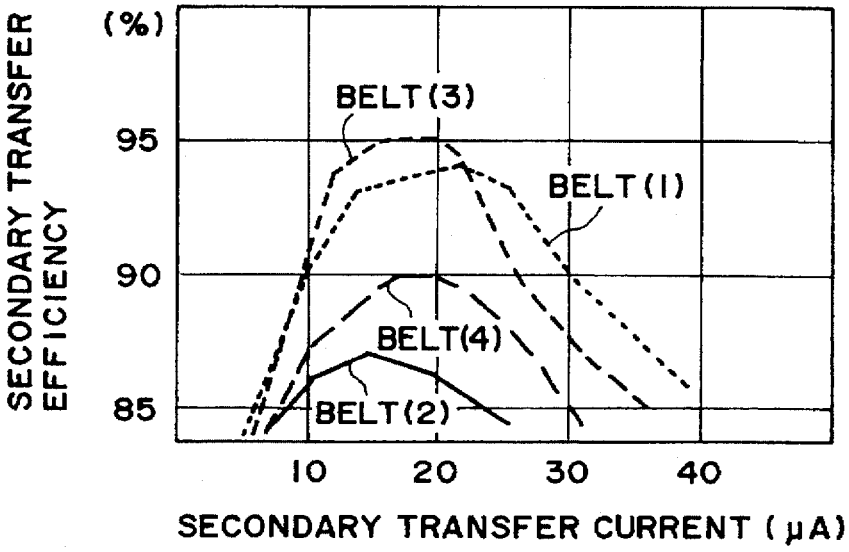

The measured results are summarized in the following Table 2 and FIG. 4B (only for the Belts (1)–(4)).

TABLE 2

Secondary transfer efficiencies ($\eta_{TF2}$) for transfer belts having varying dielectric constants and volume resistivity

| | Belt (1) | Belt (2) | Belt (3) | Belt (4) | Belt (5) | Belt (6) |
|---|---|---|---|---|---|---|
| Base layer material and thickness (μm) | PC, 150 | ←**2 | ETFE, 75 | ← | Urethane, 500 | ← |
| Surface layer material and thickness (μm) | None | ← | ← | ← | Fluorine resin, 50 | ← |
| Volume resistivity (ohm.cm) | $5\times 10^{13}$ | ← | $1\times 10^{15}$ | ← | $5\times 10^{8}$ | ← |
| Surface layer dielectric constant | ca. 7 | ca. 3 | ca. 8 | ca. 4 | ca. 9 | ca. 5 |
| Maximum of secondary transfer efficiency (%) | 94 | 87 | 95 | 90 | 95 | 92 |
| Transfer current range giving $\eta_{TF2}\geqq 90\%$ (μA) | 10–30 | None | 10–25 | 18–20 | 10–35 | 20–28 |
| Image quality* | Very good | **1 | Very good | **1 | Very good | Good |

**1: Accompanied with roughening and transfer irregularity.
**2: "←" represents the same as the left.

As is understood from Table 2 above, the secondary transfer efficiency varies depending on whether the transfer belt surface layer has a high or a low dielectric constant, and the use of transfer belts having a high dielectric constant provide a remarkably broader transfer bias application range.

The above-obtained intermediate transfer members and transfer belts were incorporated in the above-described laser printer in various combinations and evaluated in low-humidity environment and high-humidity environment, whereby the above-mentioned relative performance evaluation results of the intermediate transfer members and the transfer belts held true without change.

As described above, by using a first image-bearing member having a dielectric constant $\epsilon_d$, an intermediate transfer member having a dielectric constant $\epsilon_{ITD}$ and a transfer belt (secondary contact means) having a dielectric constant $\epsilon_{Tr}$ set to satisfy a relationship of:

$\epsilon_d \leqq \epsilon_{ITD} \leqq \epsilon_{Tr}$, and so that the intermediate transfer member has a volume resistivity of $10^6$–$10^{10}$ ohm.cm and the transfer belt has a volume resistivity of $10^8$–$10^{15}$ ohm.cm, it has become possible to obtain high transfer efficiencies over broad transfer bias application ranges. Further, even in case where the intermediate transfer member carries a portion of superposed toner layers and a portion of single toner layer in combination, both portions can be transferred without failure to provide a good transfer image. Further, it has become possible to obtain images free from transfer irregularity or transfer dropout under both low-humidity and high-humidity environments.

Second Embodiment

Figure 5:
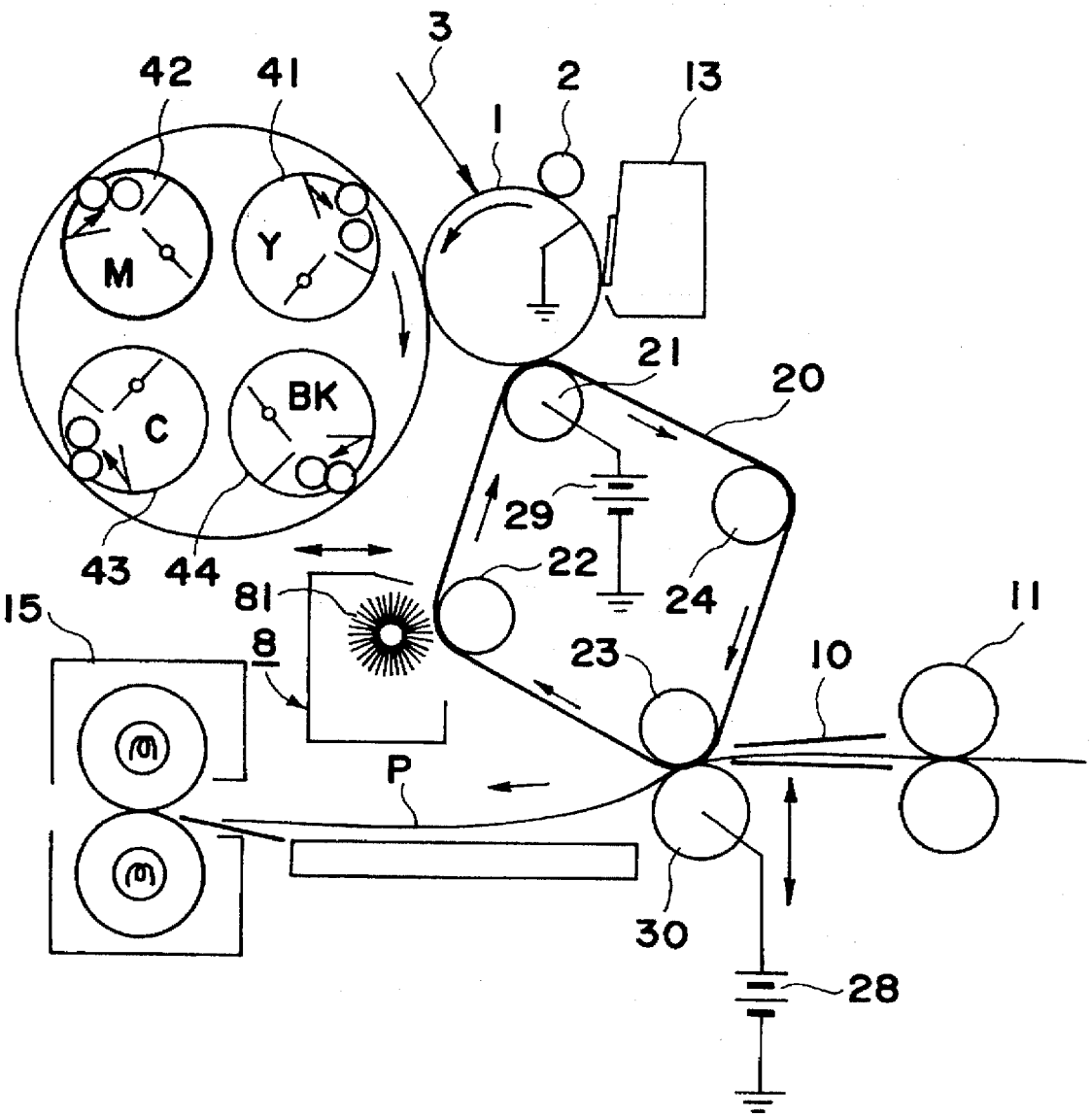
FIG. 5 is a schematic sectional view for illustrating an organization of a laser printer according to a second embodiment of the invention.

FIG. 5 is a schematic sectional view for illustrating an organization of a laser printer according to a second embodiment of the invention.

In this embodiment, a belt-type intermediate transfer member is used in combination with a roller-type secondary transfer means.

The operations in the respective steps in operation of the image forming apparatus according to this embodiment are similar to those in First Embodiment, so that the following description will be principally directed to the operation of the intermediate transfer belt 20 and the transfer roller 30.

Similarly as in the above-described First Embodiment, a yellow (first color) toner image formed on a photosensitive drum 1 is intermediately transferred onto an outer peripheral surface of the intermediate transfer belt 20 under the action of an electric field formed by a primary transfer bias voltage applied from a bias supply 29 to a bias roller 21 when it passes through a nip between the photosensitive drum 1 and the intermediate transfer belt 20 supported about the bias roller 21 disposed therebehind.

The surface of the photosensitive drum 1 after transfer of the yellow (first color) toner image to the intermediate transfer belt 20 is cleaned by a cleaning device 13.

Thereafter, a magenta (second color) toner image, a cyan (third color) toner image and a black (fourth color) toner image are sequentially transferred in superposition onto the intermediate transfer belt 20 to form a synthetic color toner image corresponding to the objective color image.

The image forming apparatus further includes a transfer roller 30, as a secondary contact transfer means, supported about a shaft extending parallel to the supporting rollers 21–24 for the intermediate transfer belt 20 so as to contact a lower part of the intermediate transfer belt 20. The transfer roller 30 is supplied with a prescribed secondary transfer bias from a secondary transfer bias supply 28.

The primary transfer bias for sequential and superposed transfer of the first to fourth color toner images from the photosensitive drum 1 to the intermediate transfer belt 20 is applied from the bias supply 29 in a polarity (+) opposite to that of the toner. During the sequential and superposed transfer of the first to fourth color toner images from the photosensitive drum 1 to the intermediate transfer belt 20, the transfer roller 30 and the intermediate transfer belt cleaner 8 may be separated from the intermediate transfer belt 20.

The synthetic color toner image transferred in superposition onto the intermediate transfer belt 20 may be transferred onto a transfer material P by causing the transfer roller 30 to abut on the intermediate transfer belt 20 and supplying the transfer material P from a paper supply cassette (not shown) via register rollers 11 and a transfer preguide 10 to the nip between the intermediate transfer belt 20 and the transfer roller 30 at a prescribed time, when a secondary transfer bias is simultaneously supplied from the bias supply 28 to the transfer roller 30. As a result, the synthetic color toner image is transferred from the intermediate transfer belt 20 to the transfer material P.

In a specific example of this embodiment, a photosensitive drum 1 identical to the one used in the specific example in First Embodiment and having a surface layer (CT layer) having a dielectric constant of ca. 3 was used.

The intermediate transfer belt 20 is supported about four supporting and driving rollers 21–24 and rotated in an indicated arrow direction by a rotation drive device (not shown). The supporting rollers 21–24 are all made of an identical material while they can be composed of different materials, and the three rollers 22–24 other than the bias roller 21 are electrically floated. In a specific example, the rollers were all composed of a 8 mm-dia. SUS-core metal coated with a layer of NBR having a volume resistivity of $5\times10^7$ ohm.cm and a JIS A hardness of 30–35 deg. so as to provide an outer diameter of 16 mm.

Generally, the rollers 21–24, particularly the bias roller 21 may preferably have a volume resistivity of $1\times10^6$–$1\times10^{10}$ ohm.cm which does not remarkably decrease at a high voltage. Other examples of the roller materials may include: EPDM, urethane rubbers and other elastomers capable of dispersing an electroconductive filler therein.

Similarly as in First Embodiment, the intermediate transfer belt 20 may be composed of a material showing a volume resistivity of $10^6$–$10^{10}$ ohm.cm and a dielectric constant which is higher than that of the CT layer (e.g., ca. 3 for PC) of the photosensitive drum 1. In a specific example, the intermediate transfer belt 20 was formed by coating a 2 mm-thick electroconductive polyurethane sheet with a 50 μm-thick release layer of sintered PETE powder so as to exhibit a volume resistivity of $2\times10^9$ ohm.cm and a release layer dielectric constant of ca. 4.5.

The transfer roller 30 was formed by first coating an 8 mm-dia. SUS core metal with a 6 mm-thick layer of EPDM containing ketjen black and zinc oxide whisker dispersed therein as conductive fillers so as to exhibit a volume resistivity of $6\times10^6$ ohm.cm.

Then, the EPDM layer exhibiting a dielectric constant of ca. 2.2 was further coated by bonding with a 200 μm-thick PVdF sheet having a volume resistivity of $1\times10^{12}$ ohm.cm and a dielectric constant of ca. 9 so as to provide an increased surface layer dielectric constant and an overall volume resistivity as the transfer roller which was almost identical to that of the PVdF sheet.

The above-mentioned photosensitive drum 1, intermediate transfer belt 20 and transfer roller 30 were incorporated in a laser printer shown in FIG. 5 to measure the primary and secondary transfer efficiencies. The second transfer efficiency was also measured by using the above-mentioned EPDM single layer-coated drum ($\epsilon_{Tr}$=ca. 2.2) as a reference. The other conditions, such as the potential conditions for the photosensitive drum, the toner, the environment and the transfer paper, were all identical to those in First Embodiment.

Figure 6A:
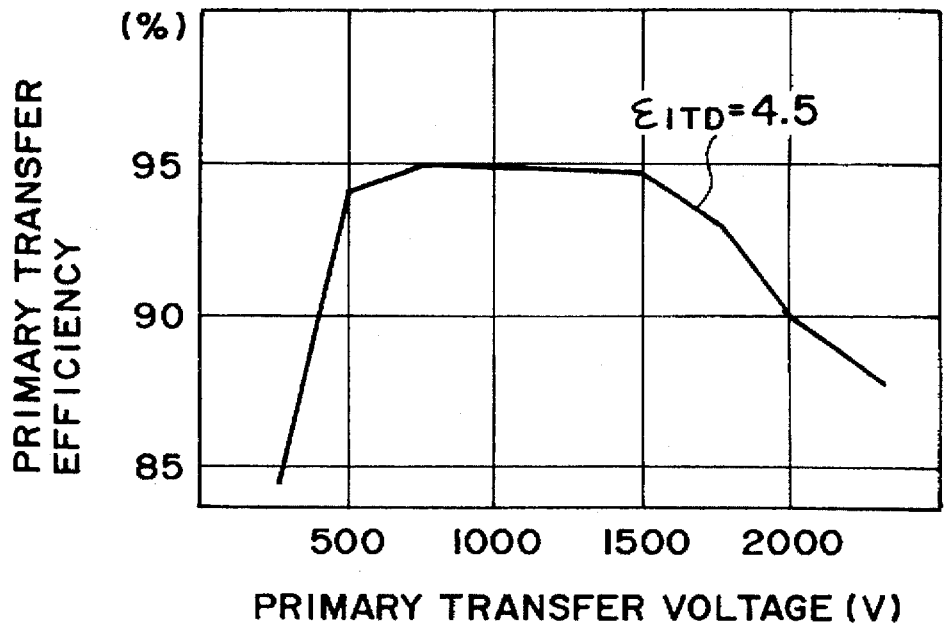
FIGS. 6A and 6B are graphs showing primary transfer efficiencies and secondary transfer efficiencies, respectively, in second type of image forming apparatus.
Figure 6B:
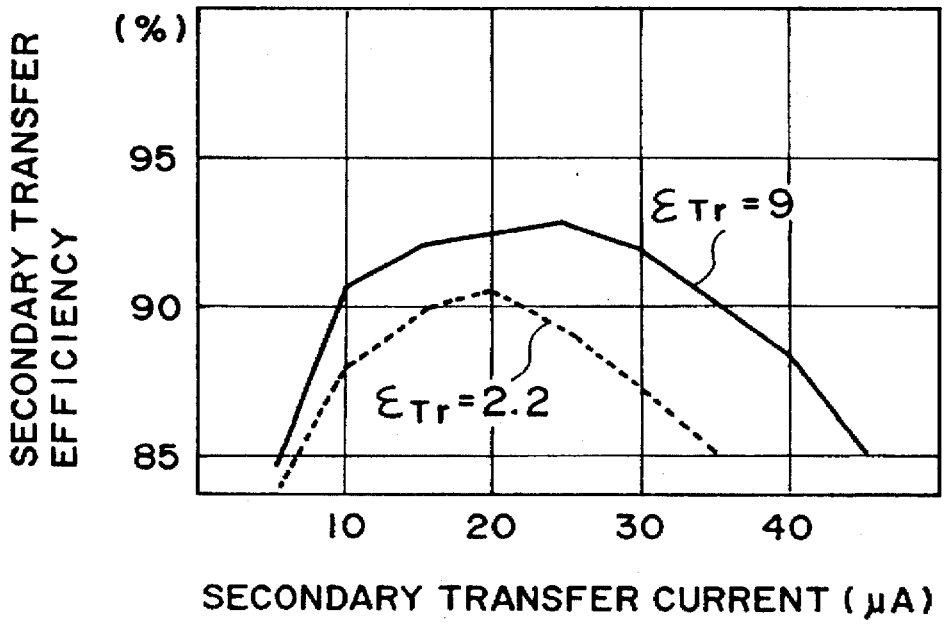

The results are summarized in FIGS. 6A and 6B. As is shown in FIG. 6B, a transfer roller having a larger surface layer dielectric constant provided a higher secondary transfer efficiency and also a broader transfer bias application range.

Similar evaluation was performed also in low-humidity and high-humidity environments, whereby the transfer roller having a high surface layer dielectric constant exhibited better transfer efficiencies also in those environments.

The combination of an intermediate transfer belt and a transfer roller (as a secondary contact transfer means) adopted in this embodiment provides a better spatial efficiency, a simple structure and a lower production cost than in the combination of an intermediate.transfer roller and a transfer belt for secondary transfer adopted in First Embodiment so that it is believed to be particularly advantageous in the present invention.

As described above, also in the case of using a belt-type intermediate transfer member and a transfer roller as a.secondary contact transfer means, by designing these members so as to set the dielectric constants $\epsilon_{ITD}$ and $\epsilon_{Tr}$ of these members in combination with a first image-bearing member having a dielectric constant $\epsilon_d$, to satisfy a relationship of:

$$\epsilon_d \leqq \epsilon_{ITD} \leqq \epsilon_{Tr},$$

and so that the intermediate transfer belt has a volume resistivity of $10^6$–$10^{10}$ ohm.cm and the transfer roller has a volume resistivity of $10^8$–$10^{15}$ ohm.cm, it has become possible to obtain high transfer efficiencies over broad transfer bias application ranges. Further, even in case where the intermediate transfer member carries a portion of superposed toner layers and a portion of single toner layer in combination, both portions can be transferred without failure to provide a good transfer image. Further, it has become possible to obtain images free from transfer irregularity or transfer dropout under both low-humidity and high-humidity environments.

The present invention is also effectively applicable to a photosensitive member in other forms than a photosensitive drum, e.g., a belt-form photosensitive member.

Third Embodiment

Figure 7:
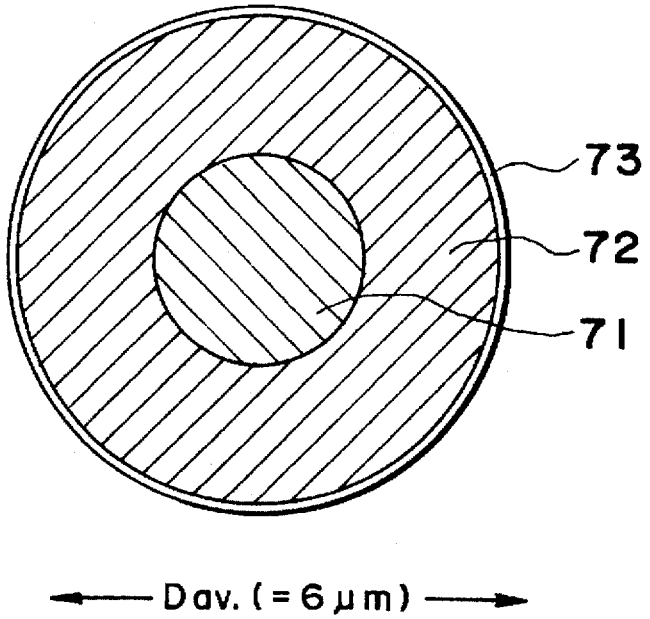
FIG. 7 is a schematic sectional view of a polymerization toner particle suitably used in an embodiment of the invention.

In this embodiment, a non-magnetic toner directly produced through polymerization and comprising toner particles each having a sectional structure as schematically shown in FIG. 7, i.e., a core of a low-softening point substance (wax) 71 enclosed within a resin layer 72 and coated with a surface layer 73, is used in an apparatus as shown in FIG. 1.

The non-magnetic polymerization toner may preferably comprise non-magnetic mono-component-type polymerization toner particles obtained, e.g., by suspension polymerization and containing 5–30 wt. % of a low-softening point substance. The toner particles may preferably be substantially spherical as represented by shape factors SF1 of 100–120 and SF2 of 100–120 and have an average particle size (Day.) of 5–7 μm. In a specific example, a toner having SF1 and SF2 of respectively 100 and an average particle size (Day.) of 6 μm was used.

It is believed that a toner particle shape close to a sphere provides a higher transfer efficiency. This is presumably because individual toner particles are caused to have a lower surface energy, a higher flowability and a smaller adsorption force (image force) onto the photosensitive drum, etc., whereby they are readily influenced by a transfer electric field.

Figure 8:
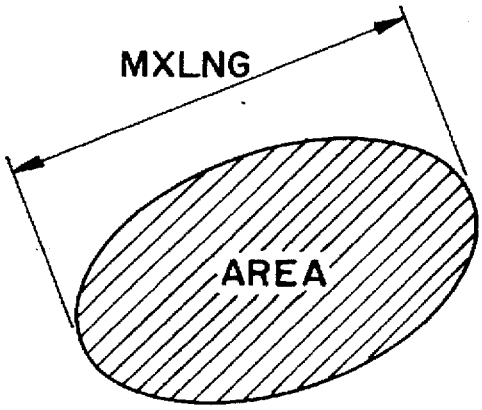
FIG. 8 is an explanatory view for illustrating a definition of a shape factor SF1.

Herein, the shape factor SF1 is a parameter representing the roundness of a spherical particle, depends on a ratio of a square of a maximum diameter MXLNG to a projection image area of a projection image of a particle onto a two-dimensional plane as illustrated in FIG. 8 and is determined by the following formula:

$$SF1=[(MXLNG)^2/AREA]\times(100\pi/4).$$

Figure 10:
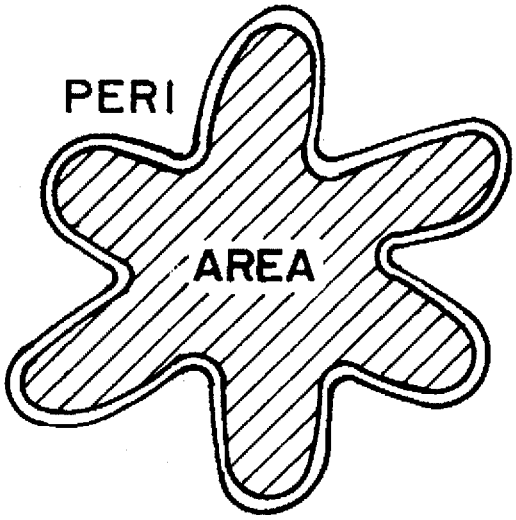
FIG. 10 is an explanatory view for illustrating a definition of a shape factor SF2.

The shape factor SF2 is a parameter representing the roughness of a spherical particle, depends on a ration of a square of a peripheral length PER1 to a projection image area AREA of a projection image of a particle onto a two-dimensional plane as shown in FIG. 10 and is determined by the following formula:

$$SF2=[(PERI)^2/AREA]\times(100\pi/4).$$

The SF1 and SF2 values referred to herein are based on values measured in the following manner.

One hundred toner particles are sampled at random. Each sample particle is observed through a scanning electrode microscope ("FE-SEM (S-800)", available from Hitachi Seisakusho K.K. ), and the image data thereof is supplied via an interface to an image analyzer ("LUZEX 3", available from Nireco K.K. ), to calculate SF-1 and SF-2 based on the above equations. The calculated values of SF-1 and SF-2 are average for the one hundred toner particles.

A toner obtained through polymerization may have a spherical shape because of its production process. In a specific example, a polymerization toner used comprised a pseudo-capsule structure roughly as illustrated in FIG. 7 including a core of ester wax, a resin layer of styrene-butyl acrylate copolymer and a surface layer of polyester. The toner had a specific gravity of ca. 1.05. The three-layer structure was adopted in order to improve the anti-offset characteristic in the fixing step by inclusion of wax in the core, and to improve the chargeability by the provision of an ester-rich surface layer. The toner particles were blended with externally added 1.2 wt. % of silicone oil-treated silica fine particles so as to stabilize the triboelectric chargeability.

More specifically, the polymerization toner particles were prepared in the following manner.

Into a 2 liter-four-necked flask equipped with a high-speed stirrer, 710 wt. parts of deionized water and 450 wt. parts of 0.1 mol/l-$Na_3PO_4$ aqueous solution were charged and warmed to 65° C. under rotation of 12000 rpm. Further, 68 wt. parts of 1.0 mol/l-$CaCl_2$ aqueous solution was gradually added thereto to form an aqueous dispersion medium containing finely dispersed sparingly water-soluble dispersing agent $Ca_3(PO_4)_2$. On the other hand, a polymerizable monomer mixture was formed from the following ingredients:

| | |
|---|---|
| Styrene monomer | 165 wt. parts |
| n-Butyl acrylate monomer | 35 wt. parts |
| C.I. Pigment Blue 15:3 | 14 wt. parts |
| Saturated polyester (terephthalic acid-propylene oxide-modified bisphenol A, acid value = 15, peak molecular weight = 6000) | 10 wt. parts |
| Salicylic acid metal compound | 2 wt. parts |
| Ester wax compound of the formula below | 60 wt. parts |

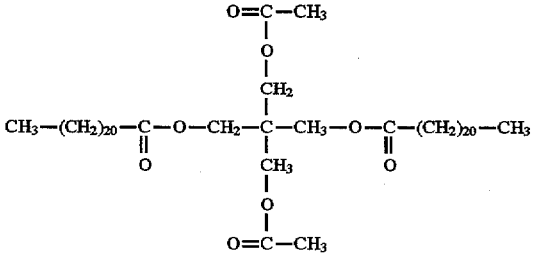

The above ingredients were dispersed for 3 hours by means of an attritor, and 10 wt. parts of 2,2'-azobis(2,4-dimethylvaleronitrile) (polymerization initiator) was added thereto to form a polymerizable monomer mixture, which was then added to the aboveprepared aqueous dispersion medium under the same high-speed rotation to be dispersed into particles in 15 min. Thereafter, the high-speed stirrer was exchanged with propeller stirring blades, and the system was heated to 80° C. under rotation at 50 rpm to effect polymerization for 10 hours. Thereafter, 2 wt. parts of styrene monomer was added to complete the polymerization. After the polymerization, the polymerization slurry was cooled and dilute hydrochloric acid was added thereto to remove the dispersion agent. Thereafter, the polymerizate particles were washed with water and dried to obtain cyan-colored polymerization toner particles.

In the above-described process, if Pigment Blue is replaced by other colorants, such as C.I. Pigment Yellow, C.I. Pigment Red 122 and carbon black, yellow toner, magenta toner and black toner can be produced respectively.

The above-prepared cyan toner exhibited a triboelectric chargeability (Q/M) of ca. −20 μC/g. The toner was incorporated in the laser printer described in First Embodiment to measure the primary and secondary transfer efficiencies.

More specifically, the laser printer included an intermediate transfer member of Sample (1) which had a 0.5 mm-thick ketjen black-dispersed acrylonitrile-butadiene rubber (NBR) layer coated with a 280 μm-thick release layer of urethane resins binder with potassium titanate whisker (conductive filler) and PTFE powder (releasability-enhancing agent) disperse therein. The surface layer dielectric constant was ca. 5. Further, the printer included a transfer belt of Belt (1) which comprised a 150 μm-thick layer comprising PC as a base material with ketjen black (conductive filler) and titanium oxide (dielectric constant controller) dispersed therein to provide a volume resistivity of $5\times10^{13}$ ohm.cm and a dielectric constant of ca. 7.

The photosensitive drum 1 used in combination with the intermediate transfer member and the transfer belt was a 180 mm dia.-OPC photosensitive drum as used in First Embodiment having a surface CT layer using a PC binder and showing a dielectric constant of ca. 3 and was subjected to image formation under the following conditions. On the photosensitive drum:

Dark part-potential (non-image part potential by primary charging): Vd=−700 V

Light part potential (image part potential By laser scanning): $V_l$=−150 V

Developing method: Jumping development using a non-magnetic mono-component developer Developing bias: Vdc=−450 V, Vac=1600 Vpp frequency=1800 Hz Process speed: 120 mm/sec.

As a reference toner, the styrene-acrylic resin-based non-magnetic monocomponent-type toner used in First Embodiment was used together with ca. 2 wt. % of externally added titanium oxide powder. The toner showed a triboelectric chargeability (Q/M) of −20 μC/g identical to the polymerization toner. The pulverization toner had an average particle size (Day.) of 8 μm and showed shape factors SF1 of 170 and SF2 of 160.

The measurement was performed in an ordinary office environment of 23° C. and 50% RH.

The secondary transfer was performed onto coated paper of 80 g/m$^2$ (prescribed for use in Canon laser copier "CLC").

Figure 9A:
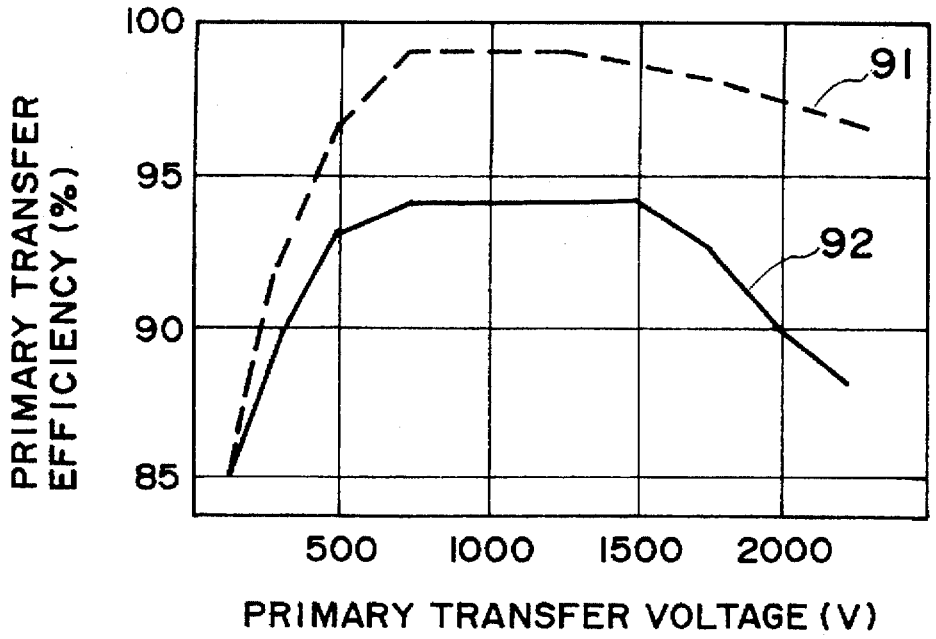
FIGS. 9A and 9B are graphs showing primary transfer efficiencies and secondary transfer efficiencies, respectively, for two types of toners (polymerization toner and pulverization toner).
Figure 9B:
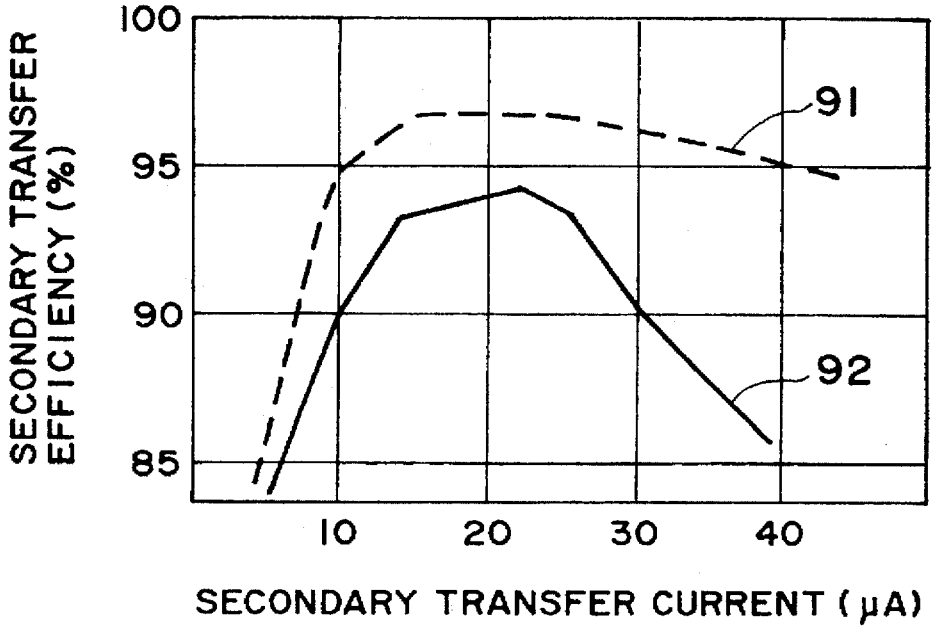

FIGS. 9A and 9B show the measured results of primary transfer efficiency and secondary transfer efficiency, respectively, wherein the curves 91 and 92 represent the results of the polymerization toner and the pulverization toner, respectively.

As shown in FIGS. 9A and 9B, the polymerization toner provided primary and secondary transfer efficiencies higher by about 5 % than those obtained by the pulverization toner. Further, the polymerization toner also provided enlarged transfer bias application ranges.

As described above, the effects of using an intermediate transfer member and a second contact transfer. means having specified volume resistivities and surface layer dielectric constants are enhanced by using a polymerization toner having an improved sphericity.

Similar improvements can be obtained by using an intermediate transfer belt instead of the roller-type intermediate transfer member and a transfer roller instead of the transfer belt similarly as described in Second Embodiment.

Fourth Embodiment

In this embodiment, a magnetic sphered toner obtained by subjecting a conventional magnetic pulverization to a sphering treatment, is used in an apparatus as shown in FIG. 1.

Such a magnetic sphered toner may be formed, e.g., by thermally or mechanically removing the surface unevenness of a conventional toner. The thermal sphering may for example be performed by using a hot bath method of dispersing a toner in a hot water at a temperature which is higher by 5°–10° C. than the glass transition temperature of the toner, or a surface fusion method of causing the toner to contact a hot gas stream at 200°–400° C. The sphering may for example be performed by a method of deforming toner particles under application of a mechanical impact force or a method of initially producing toner particles by pulverization under conditions suitable for providing spherical particles. In a specific example, a magnetic sphered toner was prepared by applying mechanical impact to a pulverized non-spherical magnetic toner by means of a mechanical surface reformer ("Hybidizer", available from Nara Kikai Seisakusho K.K.) wherein non-spherical toner particles were moved at a high speed through minute gaps while causing collision with surface walls to be sphered. During the mechanical impact application, it is also possible to apply heat (e.g., at a temperature 5° to 10° C. higher than the glass transition temperature of the toner binder resin.

A magnetic sphered toner may have shape factors SF1 of 140–150 and SF2 of 120–130 by such a mechanical impact application and in the form of particles of 5–7 μm in average diameter with rounded corners (reduced unevenness) rather than spherical particles. In a specific example, a magnetic sphered toner was formed as a magnetic mono-component toner comprising 100 wt. parts of magnetite, 2 wt. parts of salicylic acid metal compound (charge controller-) and 100 wt. parts of styrene-acrylic resin (binder) and subjected to the mechanical impact application to have SF1 of 145, SF2 of 125 and Dav. of 6 μm. The toner particles were blended with enternally-added 1.2 wt. % of silicone oil-treated silica particles.

Similarly as a polymerization toner, a sphered toner with a reduced surface unevenness is believed to an exhibit an improved transfer efficiency because individual toner particles are caused to have a lower surface energy, a higher flowability and a small adsorption force (image force) onto the photosensitive drum, etc., whereby they are readily influenced by a transfer electric field.

The above-prepared magnetic sphered toner exhibited a triboelectric chargeability (Q/M) of ca. −15 μC/g, and was evaluated in the same manner as in Third Embodiment to measure the primary and secondary transfer efficiencies.

A reference magnetic toner having the same composition but having different shape factors SF1 of 160 and SF2 of 150 was provided without the mechanical impact application. The reference magnetic toner had an average diameter of 7 μm and an identical triboelectric chargeability of ca. −15 μC/g.

Figure 11A:
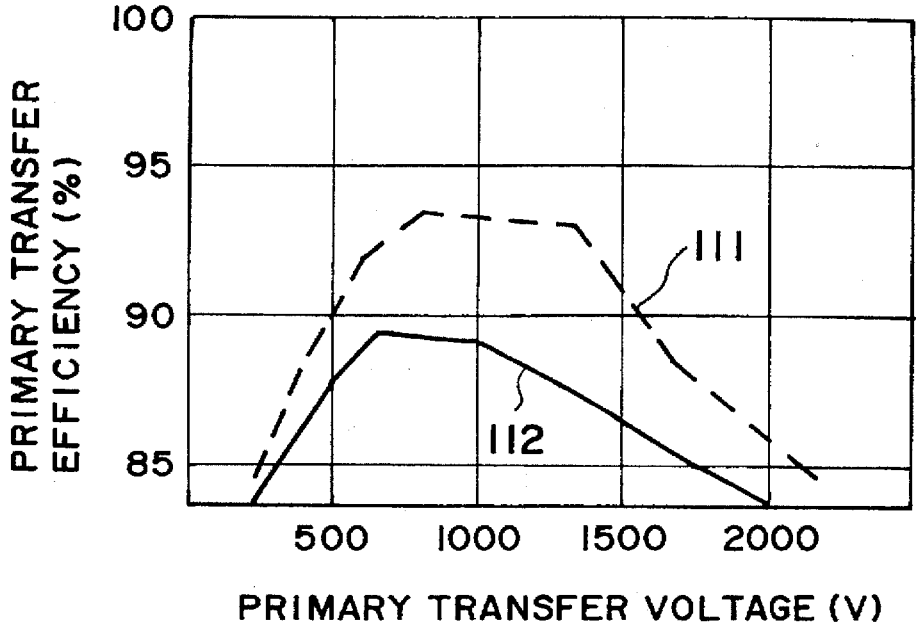
FIGS. 11A and 11B are graphs showing primary transfer efficiencies and secondary transfer efficiencies, respectively, for two types of magnetic toners (as pulverized and sphered).
Figure 11B:
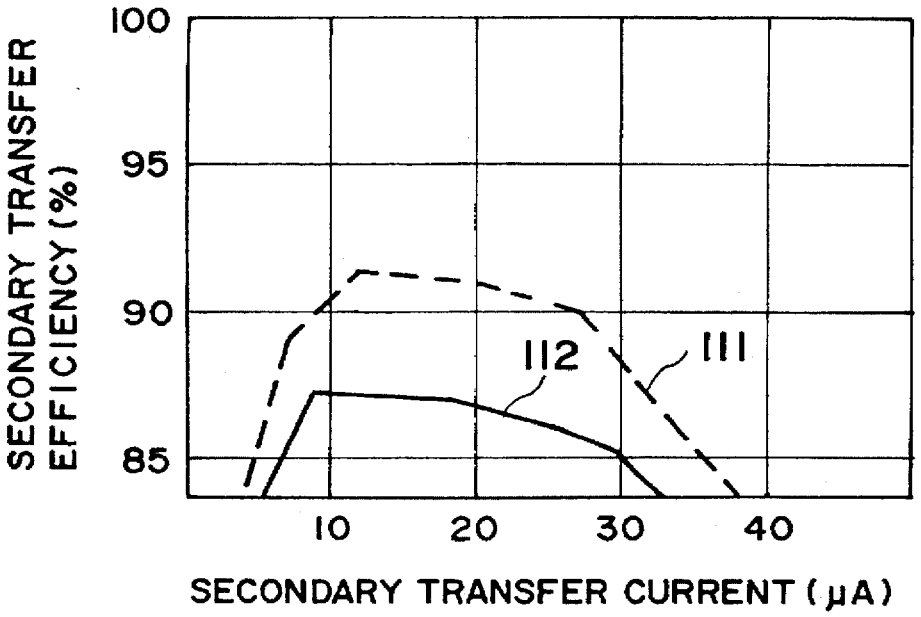

FIGS. 11A and 11B show the measured results of primary transfer efficiency and secondary transfer efficiency, respectively, wherein the curves 11L and 112 represent the results of the sphered toner and the non-sphered toner, respectively.

As shown in FIGS. 11A and 11B, the magnetic sphered toner with reduced surface unevenness provided primary and secondary transfer efficiencies higher by about 3% than those obtained by the pulverization toner. Further, the sphered toner also provided enlarged transfer bias application ranges.

As described above, the effects of using an intermediate transfer member and a second contact transfer means having specified volume resistivities and surface layer dielectric constants are enhanced by using a magnetic sphered toner having less surface unevenness. Incidentally, compared with a non-magnetic monocomponent pulverization toner and a polymerization toner, a magnetic toner has advantages of allowing a simpler developing device structure and a smaller production cost, so that the improvements in transfer efficiency given by the present invention are significant.

Similar improvements can be obtained by using an intermediate transfer belt instead of the roller-type intermediate transfer member and a transfer roller instead of the transfer belt similarly as described in Second Embodiment.

Fifth Embodiment

In this embodiment, a photosensitive drum having a lower surface layer dielectric constant prepared by coating a photosensitive drum as described above with an overcoating layer is used in an apparatus as shown in FIG. 1.

An overcoating layer is provided on a photosensitive drum generally in order to prevent the wearing or abrasion, or the cleaning failure of the photosensitive drum. In this embodiment, however, the overcoating layer is formed so as to provide a low-dielectric constant surface layer.

Figure 12:
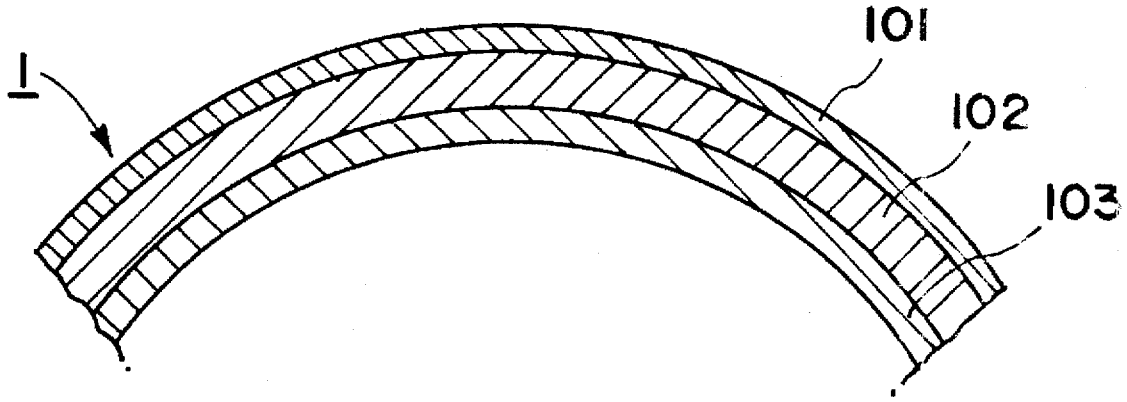
FIG. 12 is a partial enlarged sectional view of a photosensitive drum having an overcoating layer.

FIG. 12 is a partially enlarged schematic sectional view of a photosensitive drum provided with such an overcoating layer according to this embodiment. Referring to FIG. 12, the photosensitive drum 1 includes a carrier generation layer (CG layer) 103 of, e.g., 3 μm in thickness, a carrier transfer layer (CT layer) 102 of, e.g., 25 μm in thickness and an overcoating layer of, e.g., 2–5 μm in thickness.

In a specific example, a 3 μm-thick overcoating layer 101 was formed by dispersing, within 3 wt. parts of acrylic resin binder, 5 wt. parts of PTFE particles of ca. 0.3 μm in average diameter and 5 wt. parts of tin oxide particles of ca. 0.03 μm in the average diameter added so as to improve the dispersibility of the PTFE particles within the acrylic resin binder.

Figure 13:
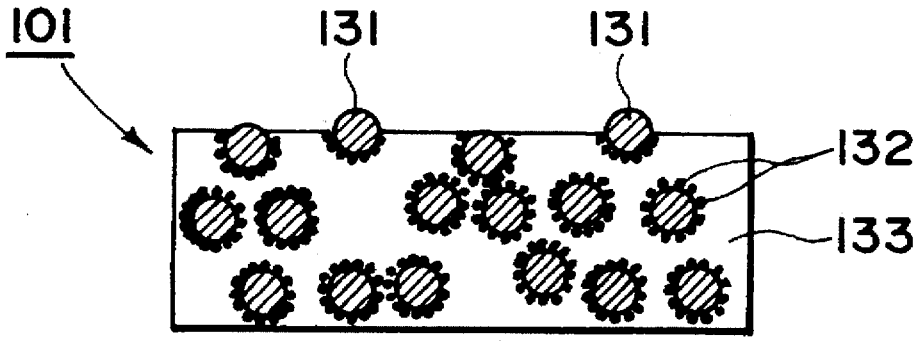
FIG. 13 is a schematic enlarged sectional view of an overcoating layer.

FIG. 13 shows an enlarged partial schematic view of such an overcoating layer 101. As shown in FIG. 13, in the overcoating layer, each PTFE 131 particle 131 is assumed to be surrounded by the tin oxide particles 132 to be dispersed in the acrylic resins binder 133.

The overcoating layer 101 exhibited ao dielectric constant of ca. 2 which was almost equal to that of PTFE. The use of a photosensitive drum having a surface layer exhibiting a lower dielectric constant provides a higher primary transfer efficiency while it does not affect a secondary transfer efficiency from an intermediate transfer member to a transfer material.

The photosensitive drum having the overcoating layer was incorporated in the laser beam printer described in Third and Fourth Embodiments together with the color polymerization toner of Third Embodiment and the black magnetic sphered toner of Fourth Embodiment and subjected to the measurement of a primary transfer efficiency in the same manner as described in Third Embodiment.

The same measurement was performed by using a photosensitive drum without the overcoating layer, i.e., one having a CT layer comprising PC as the surface layer used in Third and Fourth Embodiments, as a reference photosensitive drum.

Figure 14A:
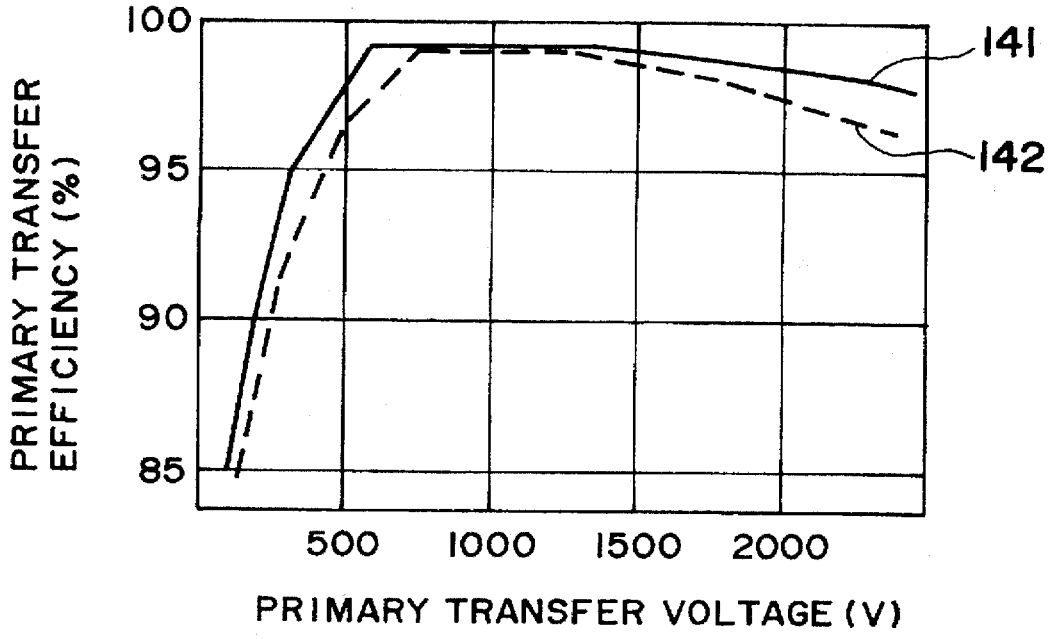
FIGS. 14A and 14B are graphs showing primary transfer efficiencies for a polymerization toner and a sphered magnetic toner, respectively, by using photosensitive drums having (141) and not having (142) an overcoating layer.

FIGS. 14A an 14B show the measured results of primary transfer efficiency for the polymerization toner and the magnetic sphered toner, respectively, wherein the curves 141 and 142 represent the results of the photosensitive drums with the overcoating layer and without the overcoating layer, respectively.

Figure 14B:
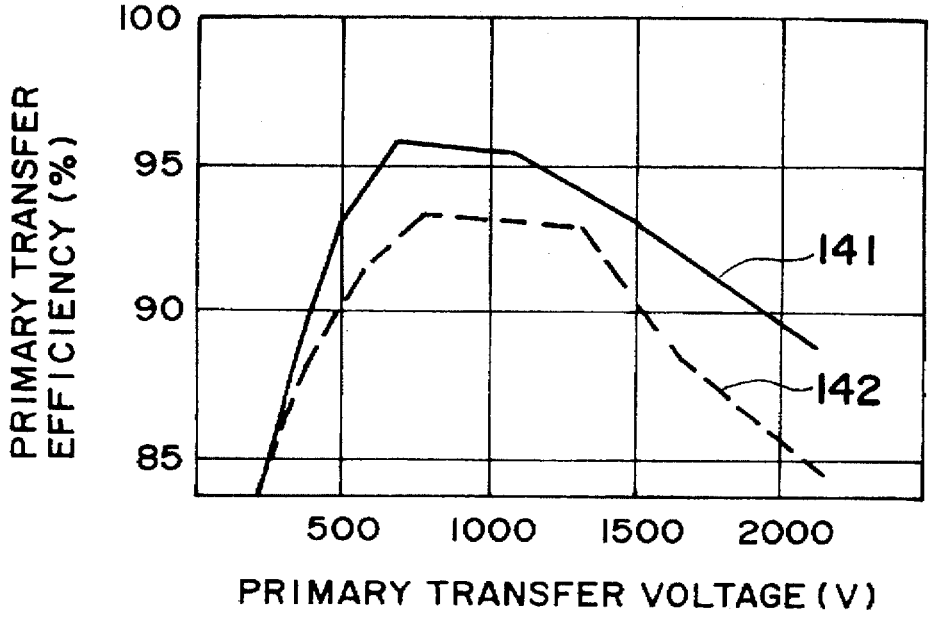

In view of FIG. 14A, the photosensitive drum with the overcoating layer did not provide a substantially higher transfer efficiency but provided a broader transfer voltage range providing a high transfer efficiency. In the case of the magnetic sphered toner shown in FIG. 14B, the photosensitive drum with the overcoating layer provided a substantial increase, as much as5%, in primary transfer efficiency, than the photosensitive drum having no overcoating layer.

The secondary transfer efficiencies were similar to those obtained in Third and Fourth Embodiments.

In the case where a high transfer efficiency can be retained over a broad transfer voltage range as described above, it is possible to attain similar transfer efficiencies by using two types of toners having different triboelectric chargeabilities. As in the case of this embodiment wherein a non-magnetic mono-component type polymerization toner is used as a color toner and a magnetic sphered monocomponent-type toner as a black toner, it is liable that the amount of waste toner is increased, thus failing to realize a high transfer efficiency, when optimum transfer bias conditions are different. However, if the dielectric constants of the overcoating layer and the intermediate transfer member are set in an appropriate relationship, the difficulty can be alleviated.

What is claimed is:

1. An image forming apparatus, comprising a first image-bearing member, an intermediate transfer member for receiving a transferable image formed on the first image-bearing member, and contact transfer means for transferring the transferable image from the intermediate transfer member to a transfer material; wherein the first image-bearing member has a surface layer having a dielectric constant $\epsilon_d$, the intermediate transfer member has a surface layer having a dielectric constant $\epsilon_{ITD}$ and the contact transfer means has a surface layer having a dielectric constant $\epsilon_{tr}$ satisfying a relationship of; $\epsilon_d \leqq \epsilon_{ITD} \leqq \epsilon_{tr}$, the intermediate transfer member exhibits a volume resistivity of $10^6$–$10^{10}$ ohm.cm (at an applied voltage of 1 kV), and the contact transfer means exhibits a volume resistivity of $10^8$–$10^{15}$ ohm.cm (at an applied voltage of 1 kV).

2. An apparatus according to claim 1, wherein the first image-bearing member and the intermediate transfer member are adapted for successive transfer of plural colors of transferable images from the first image-bearing member to the intermediate transfer member, and simultaneous transfer of the plural colors of transferable images from the intermediate transfer member to the transfer material.

3. An apparatus according to claim 1, wherein the intermediate transfer member is in the form of a roller.

4. An apparatus according to claim 1, wherein the surface layer of the intermediate transfer member is a release layer and disposed on an elastic layer.

5. An apparatus according to claim 1, adapted for using a substantially spherical non-magnetic developer having shape factors SF1 of 100–120 and SF2 of 100–120.

6. An apparatus according to claim 1, adapted for using a magnetic developer having shape factors SF1 of 140–150 and SF2 of 120–130.

7. An apparatus according to claim 1, wherein the first image-bearing member is coated with an overcoating layer having a low dielectric constant.

8. An apparatus according to claim 7, wherein the overcoating layer has a dielectric constant of at most 3.

9. An apparatus according to claim 1, wherein $\epsilon_d$, $\epsilon_{ITD}$ and $\epsilon_{tr}$ satisfying a relationship of $\epsilon_d < \epsilon_{ITD} \leqq \epsilon_{Tr}$.

10. An apparatus according to claim 9, wherein $\epsilon_d$, $\epsilon_{ITD}$ and $\epsilon_{tr}$ satisfying relationships of $\epsilon_d + 1 \leqq \epsilon_{ITD}$ and $\epsilon_{ITD} + 1 \leqq \epsilon_{tr}$.

* * * * *

UNITED STATES PATENT AND TRADEMARK OFFICE

CERTIFICATE OF CORRECTION

PATENT NO. : 5,701,568

DATED : December 23, 1997

INVENTOR(S) : KOICHI HIROSHIMA ET AL.

It is certified that error appears in the above-identified patent and that said Letters Patent is hereby corrected as shown below:

COLUMN 1

Line 13, "once" should read --first--.

COLUMN 3

Line 36, "of;" should read --of--.

COLUMN 4

Line 67, "Mount" should read --amount--.

COLUMN 6

Line 9, "$d^{tr}$" should read --$d_{Tr}$--;
Line 44, "$\delta$ is given by $\delta$" should read --$\sigma$ is given by $\sigma$--.

COLUMN 7

Line 19, "a" should read --as--;
Line 37, "in case" should read --in a case--.

COLUMN 8

Line 3, "an" should read --a--;
Line 30, "sequentially transferred" should read --are sequentially transferred--.

UNITED STATES PATENT AND TRADEMARK OFFICE

CERTIFICATE OF CORRECTION

PATENT NO. : 5,701,568

DATED : December 23, 1997

INVENTOR(S) : KOICHI HIROSHIMA ET AL.

It is certified that error appears in the above-identified patent and that said Letters Patent is hereby corrected as shown below:

COLUMN 9

Line 64, delete "is" (first occurrence).

COLUMN 11

Line 9, "h" should read --b--;
Line 17, "2" should read --$\eta$-;
Line 35, "2" should read --$\eta$-;
Line 55, "JI8" should read --JIS--.

COLUMN 12

Line 9, "thermoserring" should read --theremosetting--;
Line 29, "6 transfer belts" should read --6 transfer belts will next be described--;
Line 57, "flufine" should read --fluorine--.

COLUMN 13

Line 9, "s" should read --as--;
Line 55, "$\epsilon_d \leqq \epsilon_{ITD} \leqq \epsilon_{Tr}$, and so that the intermediate transfer mem-" should read --$\epsilon_d \leqq \epsilon_{ITD} \leqq \epsilon_{Tr}$,--;
Line 56, "ber has a" should read --and so that the intermediate transfer member has a--
Line 60, "in case" should read --in a case--.

UNITED STATES PATENT AND TRADEMARK OFFICE

CERTIFICATE OF CORRECTION

PATENT NO. : 5,701,568

DATED : December 23, 1997

INVENTOR(S) : KOICHI HIROSHIMA ET AL.

It is certified that error appears in the above-identified patent and that said Letters Patent is hereby corrected as shown below:

COLUMN 16

Line 11, "intermediate." should read --intermediate--;
Line 16, "as a." should read --as a--;
Line 26, "in case" should read --in a case--;
Line 52, "(Day,)" should read --(Dav.)--;
Line 54, "(Day,)" should read --(Dav.)--.

COLUMN 17

Line 3, "ration" should read --ratio--.

COLUMN 18

Line 27, "disperse" should read --dispersed--;
Line 57, "(Day.)" should read --(Dav.)--.

COLUMN 19

Line 40, "resin." should read --resin).--;
Line 48, "controller-)" should read --controller)--;
Line 52, "enternally" should read --externally--;
Line 55, "to an" should read --to--.

COLUMN 20

Line 6, "11L" should read --111--;
Line 54, "PTFE 131 particle 131" should read --PTFE particle 131--;

UNITED STATES PATENT AND TRADEMARK OFFICE

CERTIFICATE OF CORRECTION

PATENT NO. : 5,701,568

DATED : December 23, 1997

INVENTOR(S) : KOICHI HIROSHIMA ET AL.

It is certified that error appears in the above-identified patent and that said Letters Patent is hereby corrected as shown below:

Line 57, "ao" should read --a--.

COLUMN 22

Line 5, "$\epsilon_{tr}$" should read --$\epsilon_{Tr}$--;
Line 6, "$\epsilon_{tr}$" should read --$\epsilon_{Tr}$--;
Line 39, "$\epsilon_{tr}$" should read --$\epsilon_{Tr}$--;
Line 40, "$\epsilon_{tr}$" should read --$\epsilon_{Tr}$--;
Line 41, "$\epsilon_{tr}$" should read --$\epsilon_{Tr}$--.

Signed and Sealed this

Twenty-ninth Day of September, 1998

*Attest:*

*Attesting Officer*

BRUCE LEHMAN

*Commissioner of Patents and Trademarks*